US007021621B2

(12) United States Patent
Asada et al.

(10) Patent No.: US 7,021,621 B2
(45) Date of Patent: Apr. 4, 2006

(54) SHEET-SUPPLY DEVICE AND PRINTING DEVICE INCLUDING THE SAME

(75) Inventors: Tetsuo Asada, Kuwana (JP); Takatoshi Takemoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 171 days.

(21) Appl. No.: 10/619,470

(22) Filed: Jul. 16, 2003

(65) Prior Publication Data

US 2004/0012140 A1 Jan. 22, 2004

(30) Foreign Application Priority Data

Jul. 19, 2002 (JP) ..... 2002-210504

(51) Int. Cl.
*B65H 3/52* (2006.01)

(52) U.S. Cl. ..... 271/124; 271/167; 347/104

(58) Field of Classification Search ..... 271/162, 271/137, 104, 167, 124, 121, 149, 276, 196, 271/197; 347/104; 400/579, 582; 101/419, 101/448

See application file for complete search history.

(56) References Cited

U.S. PATENT DOCUMENTS 3,989,238 A * 11/1976 McCarthy et al. ..... 271/124
4,501,417 A * 2/1985 Foster et al. ..... 271/124
5,615,874 A * 4/1997 Parthasarathy et al. ..... 271/121
6,133,931 A * 10/2000 Yoshikawa et al. ..... 347/213
6,491,295 B1 * 12/2002 Otsuka et al. ..... 271/118
6,502,816 B1 * 1/2003 Inoue et al. ..... 271/121
6,546,210 B1 * 4/2003 Nakamura ..... 399/12
6,663,098 B1 * 12/2003 Teo et al. ..... 271/121
2002/0011702 A1 1/2002 Otsuka et al.

FOREIGN PATENT DOCUMENTS

EP 1 160 185 A2 12/2001
JP A 11-71036 3/1999
JP A 2000-191169 7/2000
JP A 2001-253580 9/2001
JP A 2001-341876 12/2001
JP A 2001-354330 12/2001

OTHER PUBLICATIONS

Asada et al., "Sheet Supply Device", 116246, Jul. 16, 2003.

* cited by examiner

*Primary Examiner*—Donald Walsh
*Assistant Examiner*—Thomas Morrison
(74) *Attorney, Agent, or Firm*—Oliff & Berridge, PLC

(57) ABSTRACT

In a sheet-supply device, a substantially T-shaped cutaway portion is provided in a projected portion, which is provided to an inclined wall and at a position corresponding to a sheet-supply roller near a lower end of the inclined wall that holds a stack of sheets loaded to a hopper portion. A first friction member is slidably supported in the cutaway portion so as to slide along the inclined wall from a downstream, normal position to an upstream position in a sheet feed direction. The first friction member includes a base portion and a pad portion, the pad portion is made of corkrubber and adhered to a surface of the base portion. A frictional coefficient μ of the pad portion is relatively high, i.e., frictional coefficient between adjacent sheets (approximately 0.6)≦μ≦1.0.

20 Claims, 19 Drawing Sheets

SHEET-SUPPLY DEVICE AND PRINTING DEVICE INCLUDING THE SAME

BACKGROUND OF THE INVENTION

1. Field of Invention

The invention relates to a sheet-supply device that supplies sheets, one by one, from a stack of sheets held in an inclined position by a hopper portion, by rotation of a sheet-supply roller and a printing device including the sheet-supply device. More particularly, the invention pertains to a sheet-supply device that can smoothly convey a last one sheet in a direction reverse to a sheet feed direction without any interference.

2. Description of Related Art

Typically, various recording devices, such as printers and facsimile machines, include a sheet-supply device that supplies sheets, which are held by a hopper portion, one by one, by rotation of a sheet-supply roller. Two types of sheet-supply devices are practical in use. One type of sheet-supply device holds a plurality of sheets in a horizontal position, and another type of the sheet-supply devices holds a plurality of sheets in an inclined position. Recently, the latter type of sheet-supply device has been mostly adopted to save installation space. The inclined-type sheet-supply device is generally provided with a friction pad having a high coefficient of friction, near a lower end of an inclined wall that supports the sheets loaded thereon from their underside.

That is, because a multi-feed problem (two or more sheets are supplied at a time) often occurs during a sheet feed operation when the amount of remaining sheets is low, the friction pad is provided under the sheets pressed by the sheet-supply roller. By doing so, a lowermost sheet, which contacts the friction pad, is prevented from moving in a sheet feed direction due to the frictional resistance produced by the friction pad. In addition, sheets, except a topmost sheet, are also prevented from moving in the sheet feed direction because of a frictional resistance between adjacent sheets. Thus, only the topmost sheet, contacting the sheet-supply roller, is separated and supplied from the stack of sheets. Therefore, as described above, the multi-feed problem can be prevented.

In the sheet-supply device, the fed sheet is further conveyed by a pair of conveyor rollers, which are provided downstream of the sheet-supply device, to a recording unit, which is provided downstream of the conveyor rollers in the sheet feed direction. Commonly, any deviation of the sheet is corrected by the conveyor rollers. Although a drive mechanism is also involved in the correction of a sheet deviation, explanations for the correction are given without describing the operation of the drive mechanism. The correction is generally performed as described below. One method is that a sheet, which is supplied from the sheet-supply device, is thrust against the conveyor rollers so that a leading edge of the sheet contacts a nip point of the conveyor rollers and becomes bent when the conveyor rollers are not rotated, and thereafter the conveyor rollers are rotated to correct the deviation of the sheet.

Another method is as described below. A sheet is supplied by the sheet-supply device while a pair of conveyor rollers are being rotated. After a leading edge of the sheet is pinched by the pair of conveyor rollers, the rotation of the conveyor rollers is stopped. Then, the conveyor rollers are rotated in a direction reverse to the sheet feed direction until the leading edge of the sheet becomes free from the pinching of the conveyor rollers. Upon the disengagement of the leading edge of the sheet from the conveyor rollers, the reverse rotation of the conveyor rollers is stopped. Then, again, the conveyor rollers are rotated in the direction to feed the sheet to correct the deviation of the sheet.

The former method requires a drive mechanism that can separately perform the sheet feed operation and the driving of the conveyor rollers. The latter method requires a sheet feed mechanism that can convey a sheet in the reverse direction toward the hopper portion.

As described above, the friction pad, which applies a frictional resistance to the sheets, is fixedly provided near the lower end of the inclined wall in order to prevent the multi-feed problem when the amount of remaining sheets is low. However, due to types and/or sizes of sheets to be loaded, the friction pad may not apply a sufficient frictional resistance to the sheets to avoid the multi-feed problem.

In addition, the friction pad slightly protrudes from an upper surface of the inclined wall in order to effectively apply its frictional resistance to the sheets. In a case where a small-sized rigid sheet, such as a postcard, is supplied from the sheet-supply device and its deviation is corrected by the latter method described above, the sheet may pass over the friction pad or a trailing edge of the sheet barely contacts the friction pad. When the conveyor rollers are rotated in the reverse direction to feed the sheet back from this condition, the trailing edge of the sheet may dig into the friction pad or the sheet may be caught between the sheet-supply roller and the friction pad with a result of being bent into a V-shape.

As a result, a static friction with respect to the small sheet by the sheet-supply roller and the friction pad becomes large, so that various problems occur. For example, a sheet fed back in the reverse direction is bent because the sheet cannot be stably conveyed in the reverse direction, and a printing area is shifted toward the trailing edge of the sheet because the small sheet cannot be precisely conveyed in the reverse direction by a predetermined amount.

SUMMARY OF THE INVENTION

The invention provides a sheet-supply device that can smoothly convey a last sheet in a direction reverse to a sheet feed direction and surely prevents the supply of two or more sheets at a time from a stack of sheets held by a hopper portion.

According to one aspect of the invention, a sheet-supply device includes a hopper portion that has an inclined wall for holding a stack of sheets in an inclined position and a lower edge receiving portion for receiving lower edges of the sheets, a sheet feed mechanism that includes a sheet-supply roller for supplying a topmost sheet from the stack of sheets loaded on the hopper portion, and a first friction member that is provided at a position near a lower end of the inclined wall of the hopper portion and corresponding to a position where the sheet-supply roller is provided, slidably along the inclined wall between a normal position where the friction member is located during a normal sheet feed operation, and a second position upstream of the normal position in the sheet feed direction.

With this structure, the lower edges of the sheets held by the hopper portion are received by the lower edge receiving portion and the sheets are supplied one by one by the sheet-supply roller of the sheet feed mechanism. The first friction member is provided at the position near the lower end of the inclined wall and corresponding to the sheet-supply roller of the hopper portion. Therefore, even when an amount of remaining sheets is low, the frictional resistance of the first friction member acts on the sheets except a topmost sheet, whereby only the topmost sheet is separated and supplied from the stack. Accordingly, a multi-feed problem is surely prevented in the sheet-supply device.

When a small-sized sheet, such as a postcard, is supplied from the sheet-supply device and its deviation is corrected, the trailing edge of the sheet may pass over the first friction member in the sheet-supply device. However, in the sheet-supply device, the first friction member slides upward from the normal position in accordance with a reverse sheet feed operation, so that a trailing edge of the sheet and the first friction member do not move relative to each other while the small sheet is conveyed in a direction reverse to the sheet feed direction. As a result, a frictional resistance due to the relative movement of the small sheet and the first friction member is not caused, whereby the small sheet can be smoothly conveyed in the reverse direction.

The first friction member may include a pad portion having a relatively high coefficient of friction and a base portion having a relatively low coefficient of friction. Because the base portion has a low frictional coefficient, the base portion can smoothly slide along the inclined wall. In addition, because the pad portion has a high frictional coefficient, friction applied to movement of the sheet contacting the pad portion during the sheet feed operation becomes large, thereby surely preventing the multi-feed problem during the sheet feed operation.

A frictional coefficient $\mu$ of the pad portion is such that: frictional coefficient between adjacent sheets $\leqq\mu\leqq 1.0$. In this case, the frictional force, which is larger than the frictional coefficient between adjacent sheets (approximately 0.6), acts on a lowermost sheet contacting the pad portion and, thus, the substantially same frictional resistance is produced between adjacent sheets except the topmost sheet. Accordingly, the multi-feed problem is prevented, whereby only the topmost sheet is separately supplied from the stack of sheets as the rest of the sheets are surely held by the inclined wall, even when the amount of sheets is low.

The slidable distance of the first friction member may be longer than or equal to a distance that the fed sheet is conveyed upstream in the sheet feed direction after a trailing edge of the sheet is released from the sheet-supply roller in the sheet feed operation. With this structure, when the sheet is conveyed in the reverse direction by the predetermined distance toward upstream in the sheet feed direction in accordance with a start of printing on the fed sheet, the sheet can be stably conveyed in the reverse direction because the pad portion can slide upward by a sufficient distance.

The sheet-supply device may include a second friction member that is provided to the inclined wall and at a position higher than the position where the first friction member is provided. With this structure, the multi-feed problem can be further surely prevented in cooperation with the downstream first friction member and the upstream second friction member, even when there is a high possibility that the multi-feed problem occurs due to the size or type of the sheets to be supplied.

The sheet-supply device may further include a print head and a detecting unit that detects a leading edge or a width of a fed sheet. The slidable distance of the first friction member may be equal to a distance between a point where a print head starts printing and a point where the detecting unit detects the leading edge of the sheet. Accordingly, when the fed sheet is conveyed in the reverse direction by the predetermined distance toward upstream in the sheet feed direction, so that the sheet reaches the print start point after the leading edge of the sheet is detected by the detecting unit, the sheet can be stably conveyed in the reverse direction because the pad portion can slide upward by the sufficient distance.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described with reference to the accompanying drawings.

In this embodiment, the invention is applied to a sheet-supply device of a multifunctional apparatus that has a printing function, a copying function, a scanning function, a facsimile function, and a telephone function. However, it is applicable to any printing device having an inclined sheet hopper.

Figure 1:
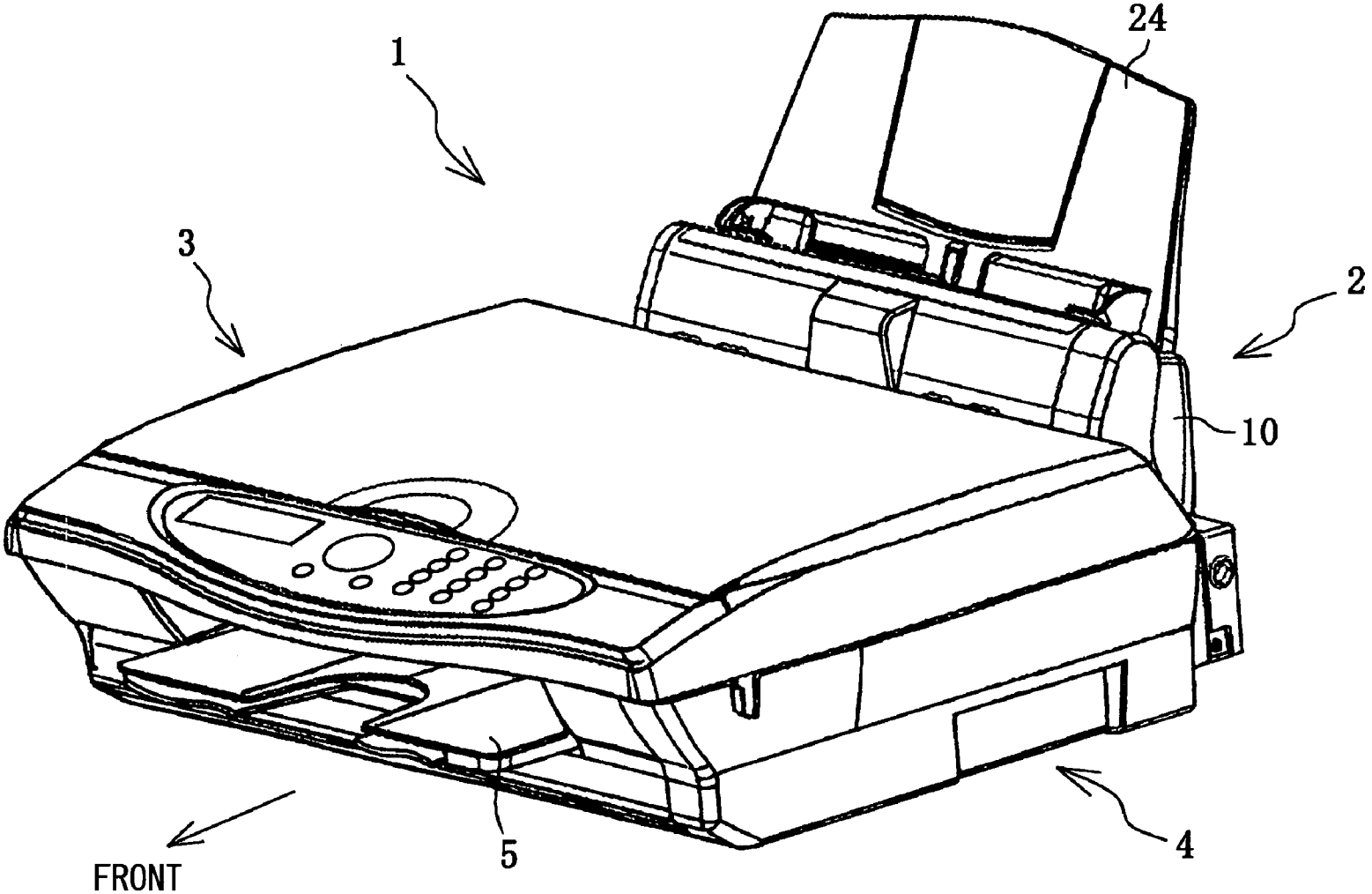
FIG. 1 is a perspective view of a multifunctional apparatus according to one embodiment of the invention.

As shown in FIG. 1, a multifunctional apparatus 1 includes a sheet-supply device 2, a document reading device 3, and an ink-jet printing device 4. The right and left sides of the multifunctional apparatus 1 are defined as right and left, respectively, when viewed from the front of the multifunctional apparatus 1. The sheet-supply device 2 is provided in the rear of the multifunctional apparatus 1. The document reading device 3, which performs the copying and facsimile functions, is provided in front of the sheet-supply device 2 and above the ink-jet printing device 4. The ink-jet printing device 4, provided below the document reading device 3, has a sheet output table 5 for receiving printed sheets, in its front.

The sheet-supply device 2 will be described with reference to FIGS. 2, 3, 5, 9, and 10. The sheet-supply device 2 includes a hopper portion 10 that holds a plurality of sheets in an inclined position, a sheet feed mechanism 11 that includes a sheet-supply roller 37, a pair of stopper members 12 provided in a bottom plate 21 of the hopper portion 10 so as to movable up and down, a position change mechanism 13 that changes a position of the stopper members 12 between a protruding position and a retracted position, a sheet feed operation mechanism 14 that drives the position change mechanism 13 and the sheet-supply roller 37 at the same time, and a sheet position control device 15.

The hopper portion 10, which is made of synthetic resin, includes an inclined wall 20, the bottom plate 21, and side walls 22, 23. The inclined wall 20 holds a stack of sheets in an inclined position. The bottom plate 21 receives lower (leading) edges of the sheets held by the inclined wall 20. The inclined wall 20 and the bottom portion 21 are connected with each other via the side walls 22, 23. A sheet guide plate 24 is detachably attached to an upper portion of the inclined wall 20. A pair of guide members 25, 26 are provided to the inclined wall 20 to guide side edges of the sheets P in a sheet width direction. The guide members 25, 26 are separately and symmetrically provided so as to move in the sheet width direction in synchronization with each other. The structure of the guide members 25, 26 is well known, so that a detailed description of the guide members 25, 26 is omitted.

Figure 5:
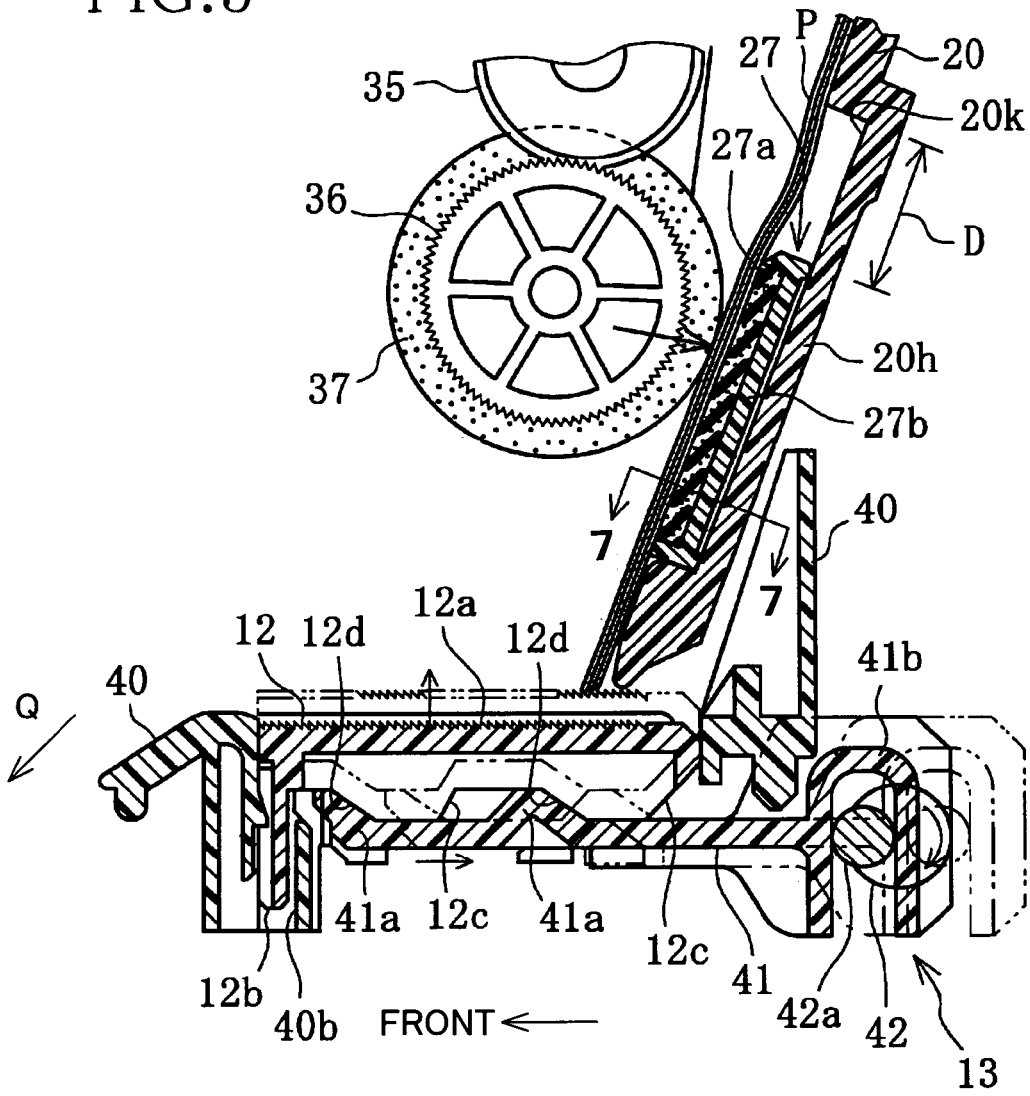
FIG. 5 is a vertical sectional view showing essential parts of the hopper portion and stopper members.

As shown in FIG. 5, a first friction member 27, which can slide in the up and down directions, is provided at a position corresponding to the sheet-supply roller 37 and near the middle in the right and left direction of the lower end of the inclined wall 20, in order to prevent two or more sheets, including a lowermost sheet, from being fed at a time (a multi-feed problem), when the amount of remaining sheets is low. The first friction member 27 normally locates at a normal position which is a downstream position in a sheet feed direction Q, under its own weight, during, for example, the sheet feed operation. The first friction member includes a pad portion 27*a* and a base portion 27*b*.

Figure 7:
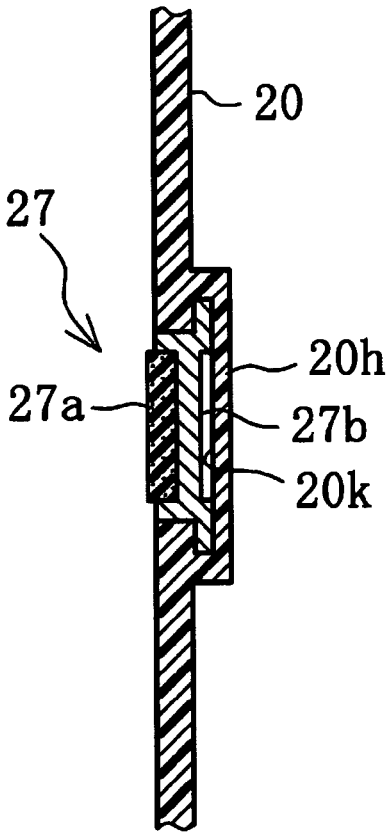
FIG. 7 is a plan view taken along a line 7—7 of FIG. 5 when viewed in a direction indicated by arrows.

As shown in FIG. 7, a substantially T-shaped cutaway portion 20*k* is provided in a projected portion 20*h* of the inclined wall 20. The base portion 27*b* is supported in the cutaway portion 20*k* so as to slide in the up and down directions. The plate-shaped pad portion 27*a*, which is made of corkrubber (the mixture of cork and rubber) having a high coefficient of friction, is adhered to an upper surface of the base portion 27*b*.

Figure 20:
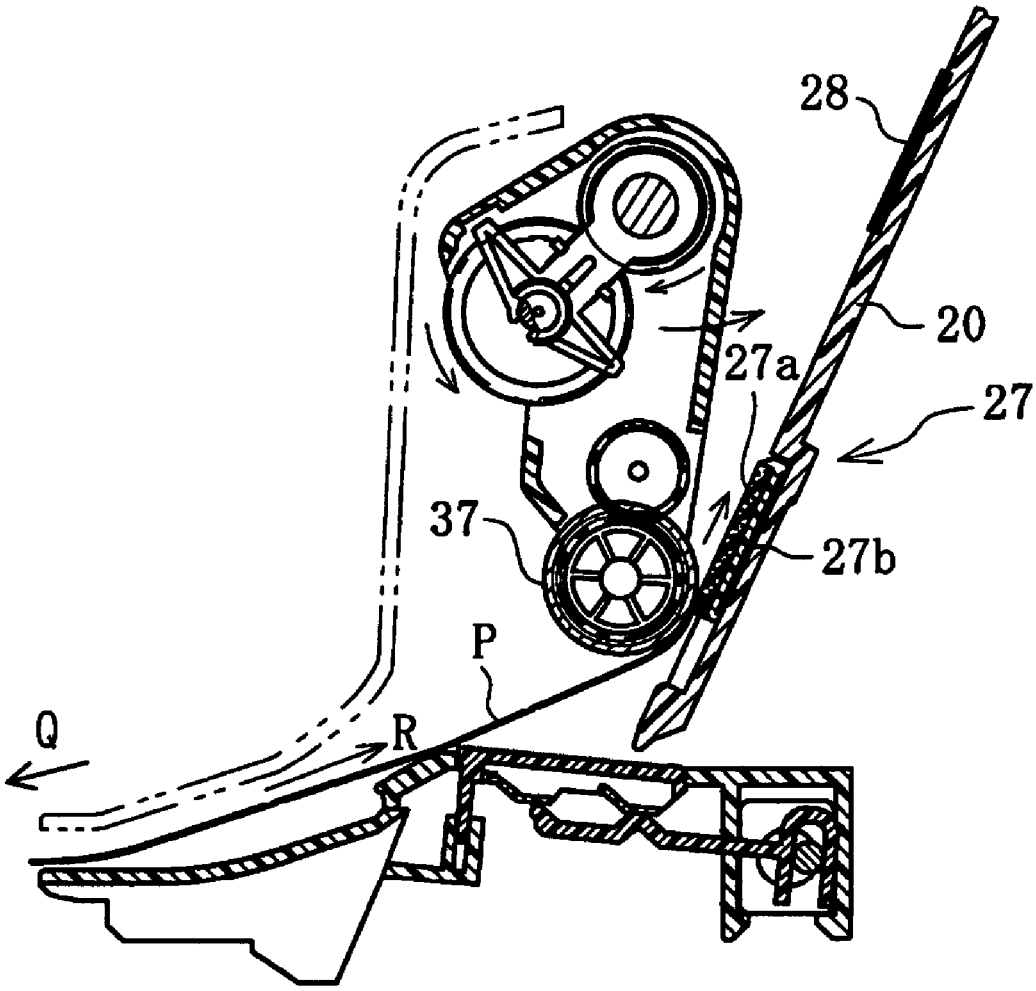
FIG. 20 is a sectional side view showing essential parts of the sheet feed mechanism, the position change mechanism, and the stopper members when the sheet is being conveyed in the reverse direction.
Figure 21:
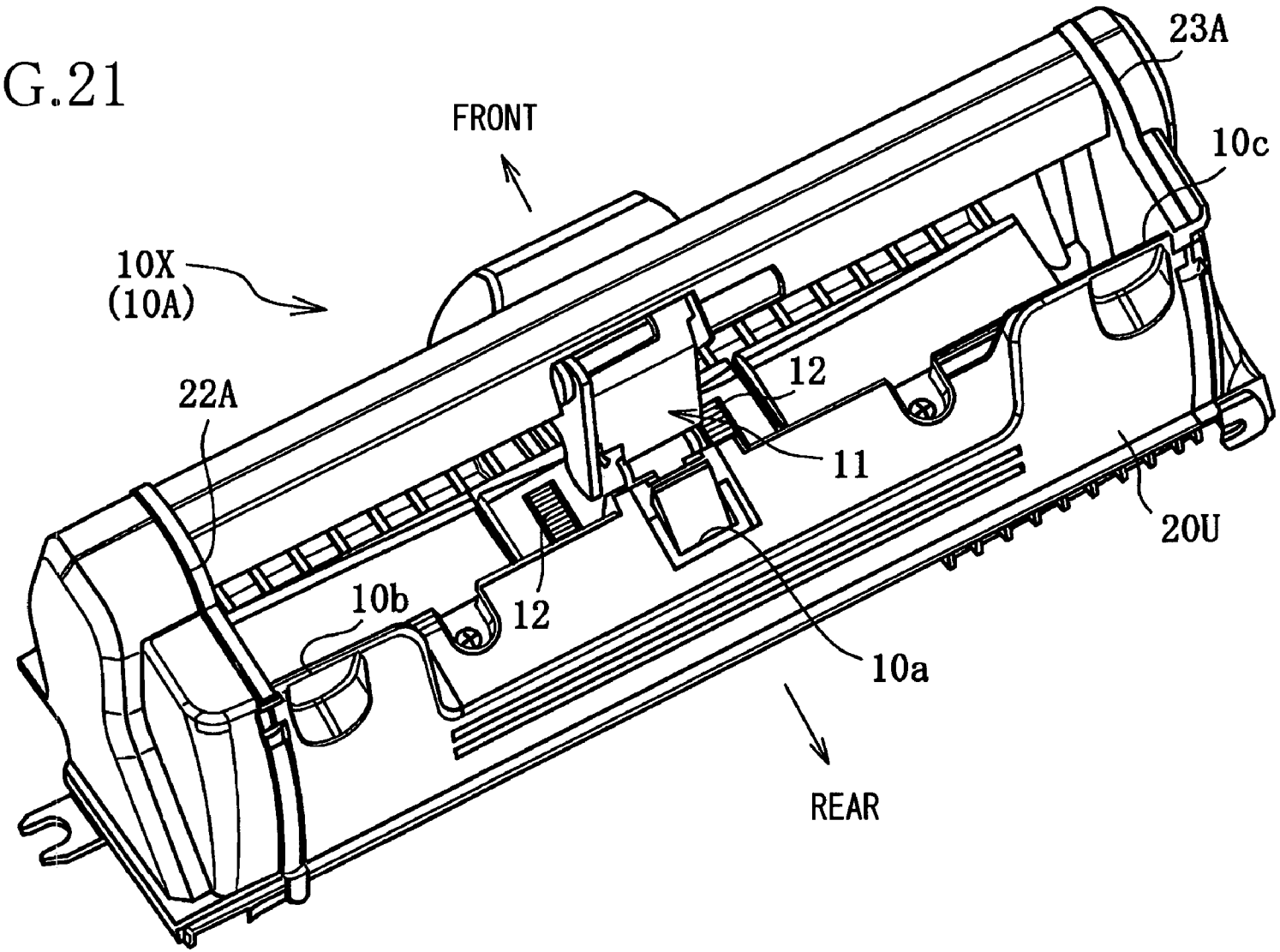
FIG. 21 is a rear perspective view of a hopper portion according to a variation of the embodiment.
Figure 22:
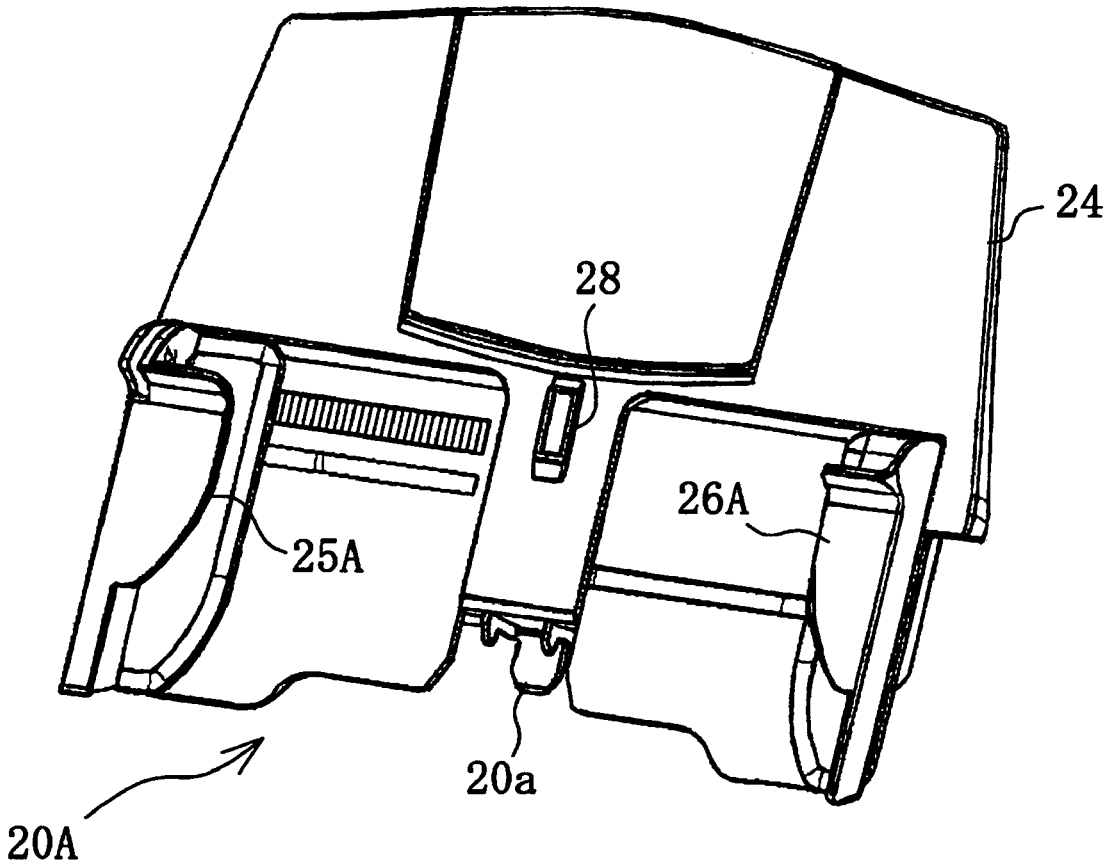
FIG. 22 is a front perspective view of an inclined wall of the hopper portion.
Figure 23:
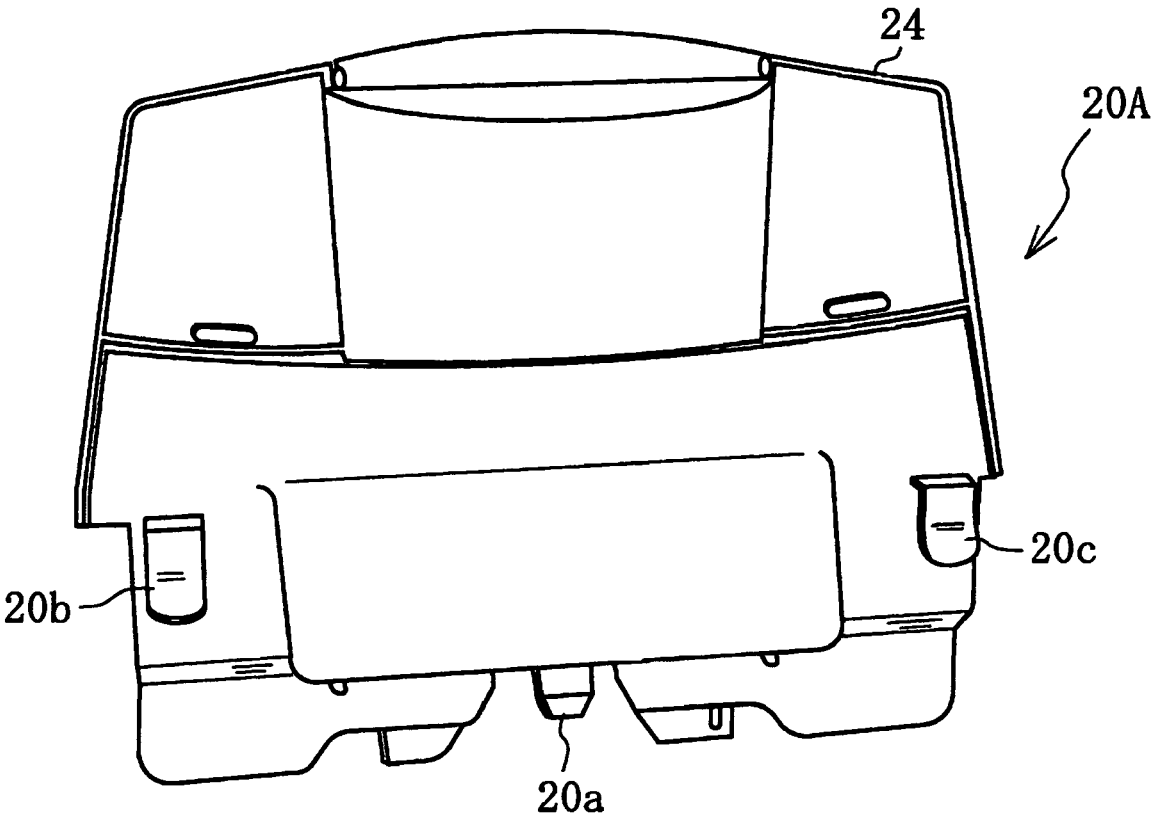
FIG. 23 is a rear perspective view of the inclined wall of the hopper portion.

In the embodiment, a frictional coefficient of the pad portion 27*a* is higher than or equal to a frictional coefficient between adjacent sheets (approximately 0.6) and lower than or equal to 1.0 (frictional coefficient between adjacent sheets $\leqq\mu\leqq 1.0$), which is a relatively high value relative to the base portion 27*b*. The base portion 27*b* has a relatively low coefficient of friction. As shown in FIG. 20, the first friction member 27 can slide upward in the sheet feed direction Q, along the inclined wall 20, from the normal position shown in FIG. 5.

In addition, a rectangular second friction member 28 is provided to the inclined wall 20 and at a position higher than the position where the first friction member 27 is provided. The second friction member 28, which is made of corkrubber having a high coefficient of friction, extends in the up and down direction in order to prevent the multi-feed problem in cooperation with the first friction member 27. The first and second friction members 27, 28 slightly project from the upper surface of the inclined wall 20 so as to be able to apply their frictional resistance to a lowermost sheet in the stack of sheets P held by the hopper portion 10.

That is, when the amount of remaining sheets P is low, the sheet-supply roller 37 presses the sheets P against the first friction member 27, so that the first friction member 27 can effectively apply its frictional resistance to the sheets P. When the amount of remaining sheets P is high, a lowermost sheet P is also pressed against the second friction member 28 under the weight of the sheets P, so that the frictional force of the second friction member 28 can effectively act on the lowermost sheet P. Thus, an avalanche/slippage of the sheets P in the sheet feed direction Q is prevented.

Figure 2:
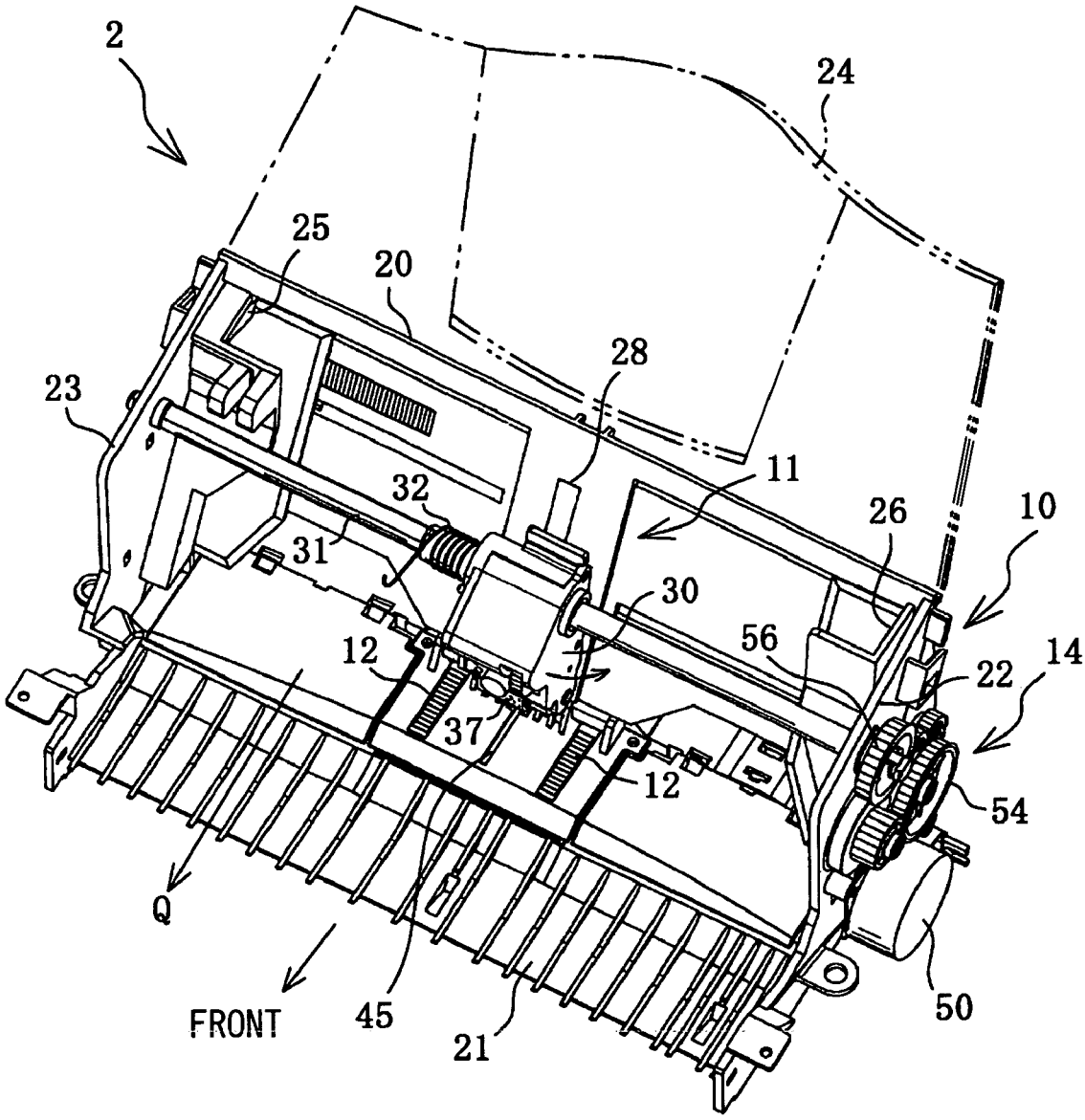
FIG. 2 is a schematic perspective view of a sheet-supply device.
Figure 9:
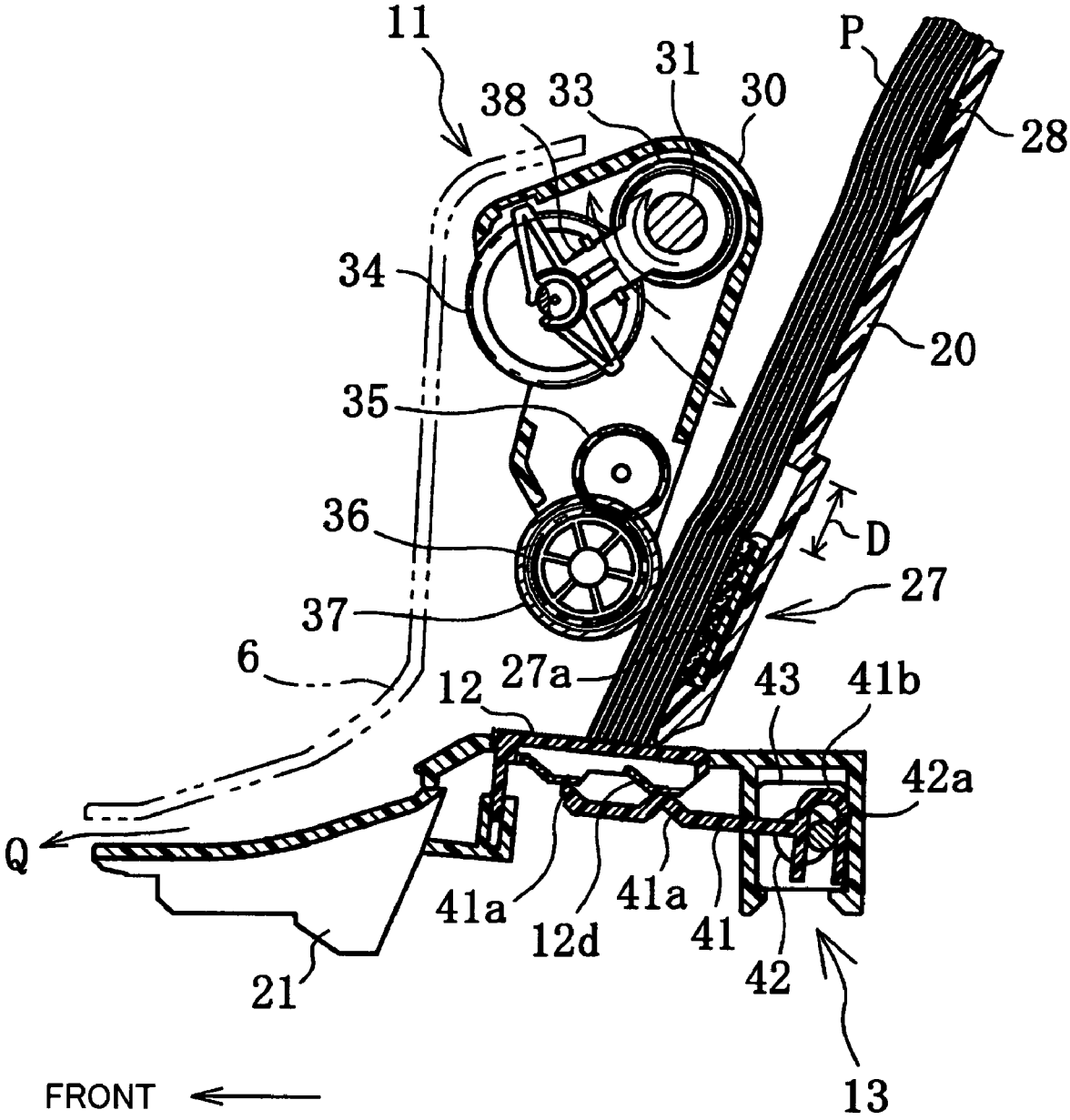
FIG. 9 is a sectional side view showing essential parts of a sheet feed mechanism, a position change mechanism, and the stopper members in a standby state of the sheet-supply device.

The sheet feeding mechanism 11 will be described below. As shown in FIGS. 2 and 9, a sheet feed shaft 31, extending in the right and left direction, is rotatably supported at each end by a respective one of the side walls 22, 23. The sheet feed shaft 31 is inserted into the sheet feed mechanism 11 to support the sheet feed mechanism 11 at a substantially middle portion of the sheet feed shaft 31 in the right and left directions. A spiral spring 32 is externally attached to the sheet feed shaft 31 so that the sheet feed mechanism 11 is elastically urged toward the inclined wall 20 at all times. In the sheet feed mechanism 11, a drive gear 33 fixed to the sheet feed shaft 31, a planet gear 34 engaged with the drive gear 33, a following gear 35, and a sheet feed gear 36 engaged with the following gear 35 are rotatably provided in a case 30. The sheet feed gear 36 is partially exposed to the outside of a case 30 that encloses the gears.

Figure 14:
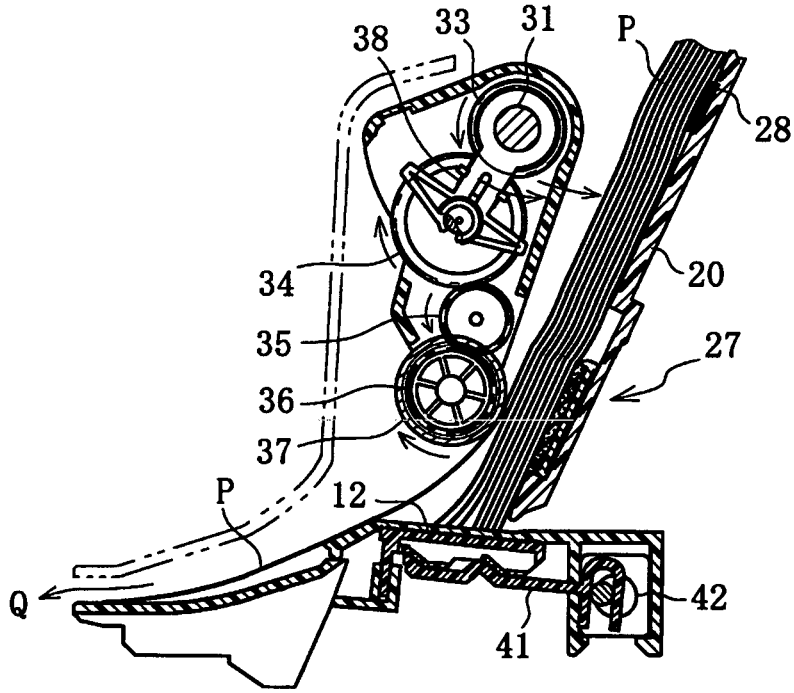
FIG. 14 is a sectional side view showing essential parts of the sheet feed mechanism, the position change mechanism, and the stopper members in process of the sheet feed operation.

The sheet-supply roller 37, made of rubber, is integrally fixed to the sheet feed gear 36. Thus, the sheet-supply roller 37 presses the lower portions of the sheets P toward the first friction member 27, i.e. the inclined wall 20, by a force from the spiral spring 32. That is, in the case 30, the drive gear 33 is fixed to the sheet feed shaft 31 and the planet gear 34 engaged with the drive gear 33 is rotatably supported by an end of a plate-shaped swing member 38, which is externally inserted onto the sheet feed shaft 31 and has a slide resistance, i.e., is fixed, with respect to the sheet feed shaft 31 to rotate therewith. When the planet gear 34 is swung to a lower connecting position (see FIG. 14) by the swing member 38, the planet gear 34 engages the following gear 35.

In FIG. 9, when the sheet feed shaft 31 rotates in the clockwise direction, the swing member 38 is swung upward by the rotation of the sheet feed shaft 31, thereby disengaging the planet gear 34 from the following gear 35. When the sheet feed shaft 31 rotates in the counterclockwise direction, the swing member 38 swings downward and the planet gear 34 engages the following gear 35, thereby feeding sheets P, one by one, by the rotation of the sheet-supply roller 37 in the clockwise direction. The sheet-supply roller 37 is elastically urged toward the sheets P at all times by the force from the spiral spring 32. The front of the sheet feed mechanism 11 and the hopper portion 10 is covered with a protection cover 6.

The pair of stopper members 12 and the position change mechanism 13, that changes the position of the stopper members 12, will be described with reference to FIGS. 2, 3, and 5. The bottom plate 21 is provided with a cutaway portion at the middle to place a sheet separating member 40 therein. The sheet separating member 40 is a separated part from the bottom plate 21. Slits 40*a*, extending in the front to rear direction, are formed in the bottom plate 21 and on both side areas of the sheet separating member 40. The stopper members 12 are provided in the slits 40*a*, respectively, so as to move up and down between the protruding position and the retracted position.

Figure 6:
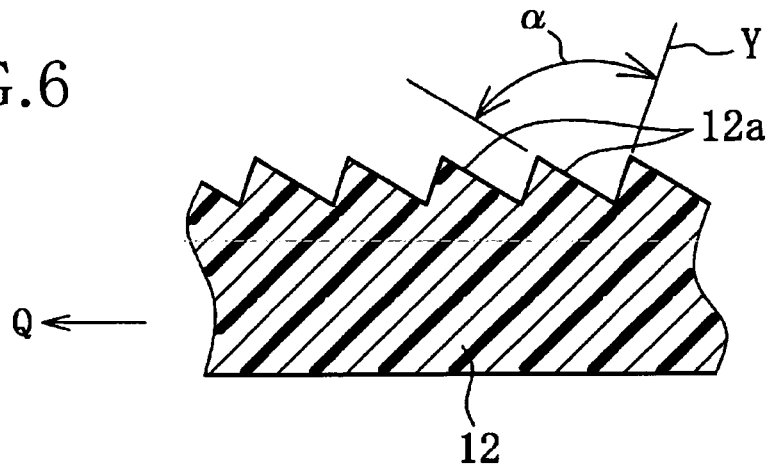
FIG. 6 is a partially enlarged view showing a regulating surface of each of the stopper members.

Each of the stopper members 12 has a saw-toothed regulating surface 12*a* as shown in FIG. 6. The regulating surface 12*a* has a plurality of sawteeth, each of which has a predetermined opening angle $\propto$ (for example, between 45 to 90 degrees) with respect to a sheet extending direction Y of the sheets P held by the hopper portion 10. With this structure, the stopper members 12 can effectively regulate the lower edges of the sheets P by the regulating surfaces 12*a* so that the lower edges of the sheets P held by the hopper portion 10 do not undesirably move in the sheet feed direction Q from a predetermined sheet holding position. A support portion 12*b* extends downward from the front end of each of the stopper members 12. Each support portion 12*b* is inserted into a support hole 40*b*, which is provided in the front end portion of the sheet separating member 40, so that the stopper members 12 move in the up and down directions.

The stopper members 12 are also supported at their rear end portions so that the stopper members 12 can move in the up and down directions. Each of the stopper members 12 has two projected portions 12*c* that project downward in a form of a trapezoid, wherein one projected portion 12*c* is disposed at the front and another projected portion 12*c* is disposed at the rear. Each of the projected portions 12*c* has an inclined guide surface 12*d* at the front side. Up-and-down moving members 41, extending in the front to rear direction, are provided under the respective stopper members 12. Each of the up-and-down moving members 41 has front and rear contact portions 41*a*, which contact the respective inclined guide surfaces 12*d* of the projected portions 12*c* from below. Each of the up-and-down moving members 41 has a reverse U-shaped drive portion 41*b* at its rear end.

Figure 3:
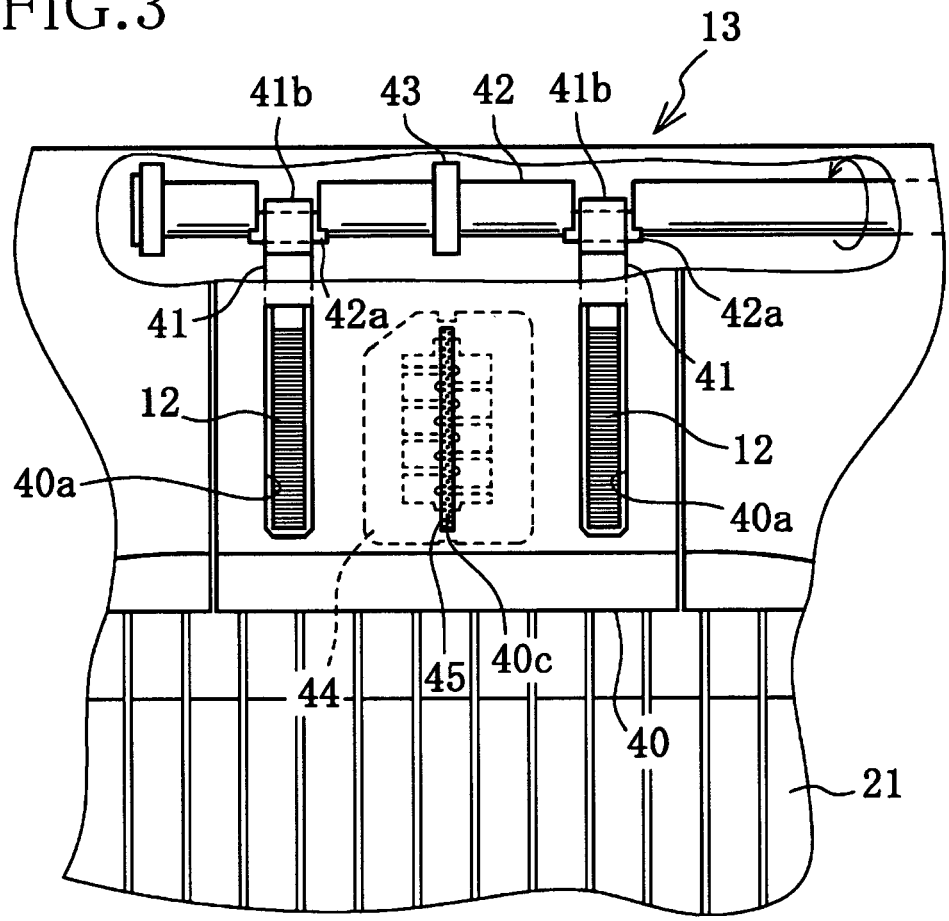
FIG. 3 is a partially cutaway plan view of a bottom plate of a hopper portion.

As shown in FIG. 3, an up-and-down moving shaft 42, extending in the right and left directions, is disposed to the immediate rear of the sheet separating member 40. The up-and-down moving shaft 42 is rotatably supported to the bottom plate 21 via support blocks 43 at several positions. Eccentric portions 42a having a predetermined width are partially provided at portions corresponding to the stopper members 12. The drive portions 41*b* of the up-and-down moving members 41 are connected to the respective eccentric portions 42*a*. As the up-and-down moving shaft 42 rotates in the clockwise direction, the eccentric portions 42*a* are located at the front position (see FIG. 5) and the contact portions 41*a* contact the inclined guide surfaces 12*d*, whereby the position of the stopper members 12 is changed to the retracted position.

When the up-and-down moving shaft 42 further rotates (see FIG. 9) and thus the eccentric portions 42*a* move to a rear position, the position of the stopper members 12 is changed to the protruding position via the contact portions 41*a* of the up-and-down moving members 41 and the projected portions 12*c* of the inclined guide surfaces 12*d*. Further, when the up-and-down moving shaft 42 further rotates and the eccentric portions 42*a* return to the front position (see FIG. 12), the position of the stopper members 12 is changed to the retracted position via the contact portions 41*a* of the up-and-down moving members 41 and the projected portions 12*c* of the inclined guide surfaces 12*d*.

The protruding position is a condition where the upper surfaces (the saw-toothed regulating surfaces 12*a*) of the stopper members 12 project approximately 1 mm from the upper surface of the sheet separating member 40. The retracted position is a condition where the upper surfaces (the saw-toothed regulating surfaces 12*a*) of the stopper members 12 lower approximately 1 mm than the upper surface of the sheet separating member 40. A slit 40*c*, extending in the front to rear direction, is provided between the stopper members 12, in the sheet separating member 40. A separating pad 45, which is made of urethane rubber, is provided in the slit 40*c* in order to apply a slide resistance to the sheets P.

Figure 4:
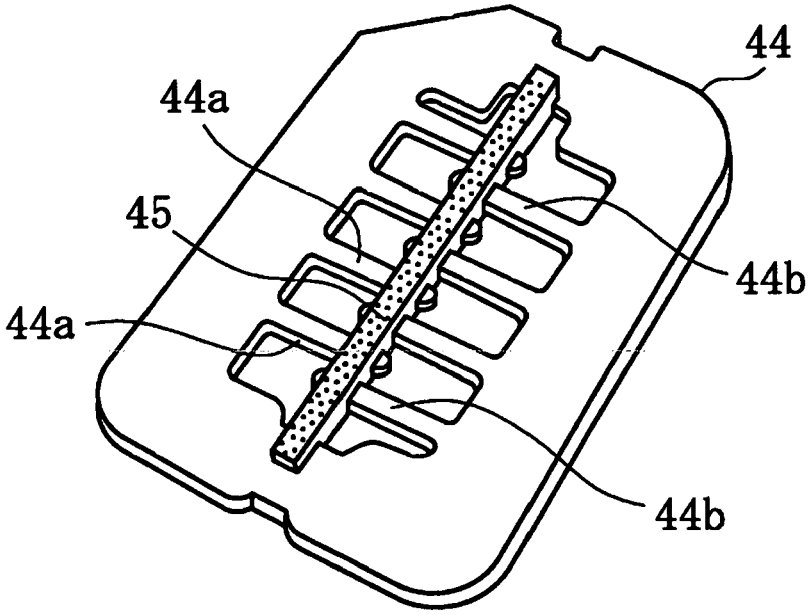
FIG. 4 is a perspective view of a separating pad and a leaf spring member that supports the separating pad.

As shown in FIG. 4, the separating pad 45 is provided to the bottom plate 21, as a lower edge support portion, with being resiliently supported by a leaf spring member 44. A plurality of left support portions 44*a* and right support portions 44*b*, which alternatively protrude inward from respective sides like a comb, resiliently support the separating pad 45 such that the left and right support portions 44*a*, 44*b* are inserted into the separating pad 45. The separating pad 45 slightly protrudes from the upper surface of the bottom plate 21 at all times. Accordingly, even when the stopper members 12 are located at the retracted position, the movement of the lower edges of the sheets P in the sheet feed direction Q is minimized by the slide resistance applied by the separating pad 45.

Figure 10:
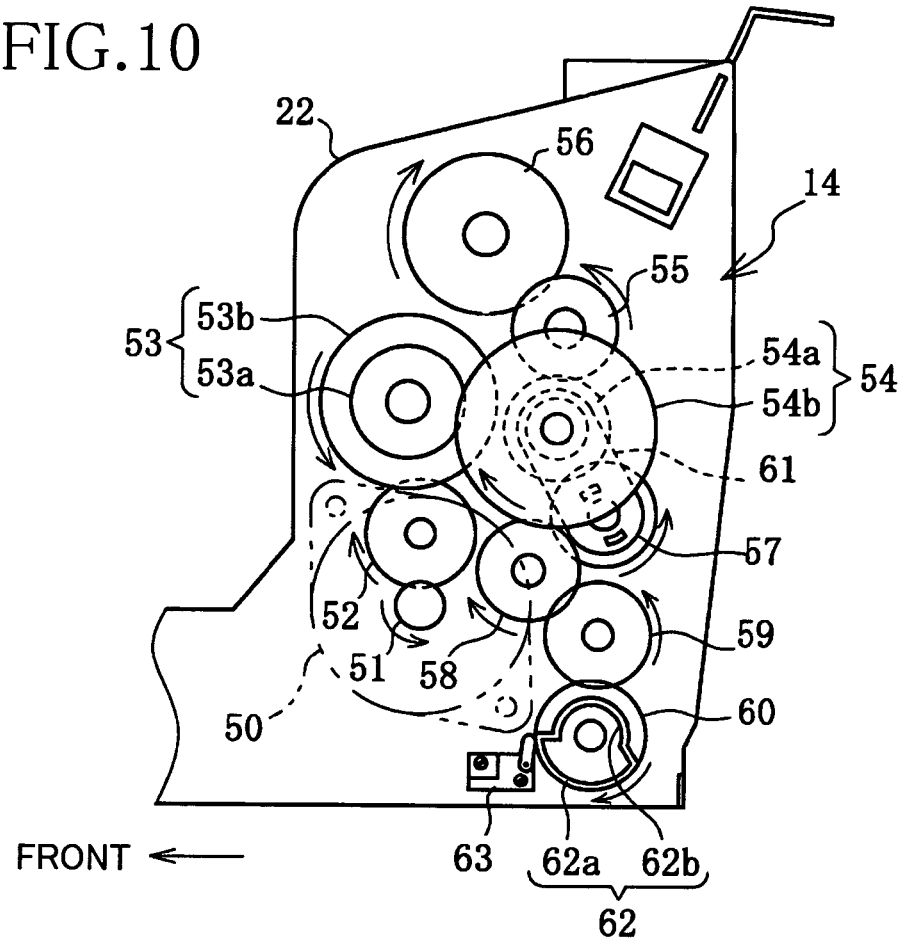
FIG. 10 is a diagram showing an operation of a sheet feed operation mechanism when the stopper members are moved up and down.

The sheet feed operation mechanism 14 will be described with reference to FIGS. 2 and 10. A sheet feed motor 50 is fixed to an outer surface of the right side wall 22. Four gears 51 to 54, including a drive gear 51 attached to the sheet feed motor 50, are rotatably supported as a drive system, as shown in FIG. 10. A gear 55 engaged with the gear 54, and a gear 56 engaged with the gear 55 are also rotatably supported to provide a sheet feed system. In addition, a gear 58 engages a planet gear 57, and gears 59, 60, are rotatably supported as shown in FIG. 10, as an up-and-down moving system for moving the stopper members 12. The sheet feed shaft 31 and the up-and-down moving shaft 42 are fixed to the gear 56 and the gear 60, respectively.

The gears 53, 54 are compound gears. The gear 53 includes a small-diameter gear 53*a* and a large-diameter gear 53*b*. The gear 54 includes a small-diameter gear 54*a* and a large-diameter gear 54*b*. That is, the gear 52 is engaged with the drive gear 51, the large-diameter gear 53*b* is engaged with the gear 52, and the large-diameter gear 54*b* is engaged with the small-diameter gear 53*a*. A plate-like swing member 61 is provided between the right side wall 22 and the compound gear 54 with its base end being rotationally fixed relative to the compound gear 54. The swing member 61 rotatably supports the planet gear 57 at its free end.

When the compound gear 54 rotates in the clockwise direction, the swing member 61 also swings in the same (clockwise) direction and, thus, the planet gear 57 engages the gear 58 (see FIG. 10). When the compound gear 54 rotates in the counterclockwise direction, the swing member 61 swings in the same (counterclockwise) direction and, thus, the planet gear 57 disengages the gear 58 (see FIG. 13). As described above, when the sheet feed motor 50 rotates in the counterclockwise direction, that is, in the reverse direction, the up-and-down moving shaft 42 rotates in the clockwise direction via the gears 57 to 60, as shown in FIG. 10. Thus, the stopper members 12 move up and down.

Although the sheet feed shaft 31 rotates in the clockwise direction while the stopper members 12 move up and down, the sheets P are not fed by the sheet-supply roller 37 because the planet gear 34 is not in engagement with the following gear 35. As the sheet feed motor 50 rotates in the clockwise direction, that is, in a normal direction, from the condition shown in FIG. 9, the planet gear 57 disengages the gear 58 (see FIG. 13), so that the stopper members 12 do not move up and down. While the stopper members 12 are maintained at the retracted position, the sheet feed shaft 31 rotates in the counterclockwise direction, so that the planet gear 34 engages the following gear 35 to feed the sheets P, one by one, by the sheet-supply roller 37 via the gears 34 to 36, as described above.

A cam member 62, which has a large-diameter cam portion 62*a* and a small-diameter cam portion 62*b*, is provided at the outside surface of the gear 60, which is the last gear in the up-and-down moving system. A sheet feed switch 63, which outputs an on signal and an off signal in accordance with the large-diameter cam portion 62*a* and the small-diameter cam portion 62*b*, is provided near the cam member 62. That is, when the sheet feed switch 63 contacts the small-diameter cam portion 62*b* from the large-diameter cam portion 62*a*, the sheet feed switch 63 outputs an off signal, which means the stopper members 12 locate at the retracted position. When the sheet feed switch 63 contacts the large-diameter cam portion 62*a* from the small-diameter cam portion 62*b*, the sheet feed switch 63 outputs an on signal, which means the stopper members 12 locate at the protruding position.

Figure 8:
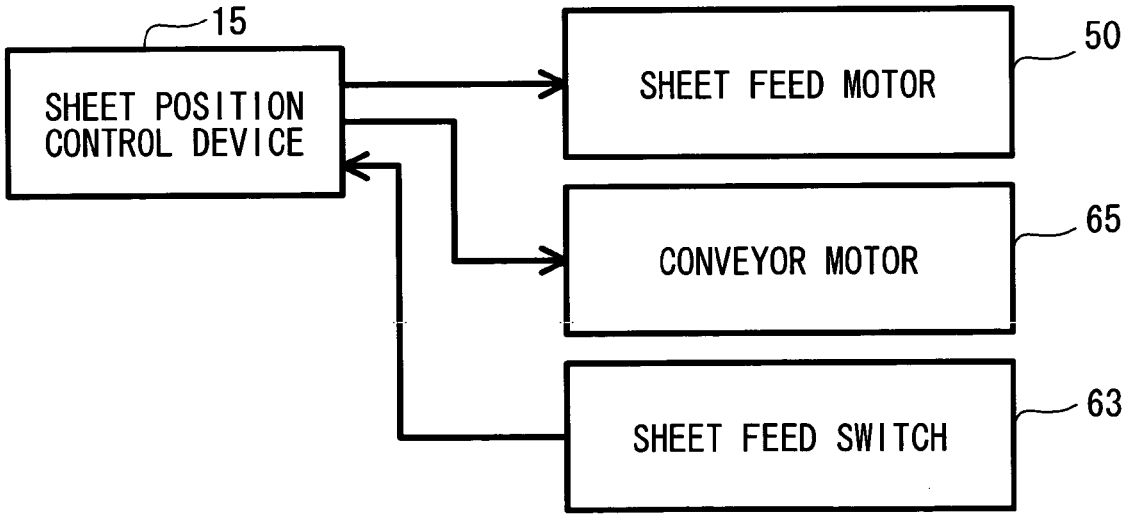
FIG. 8 is a block diagram of a control system including a sheet position control device.

The sheet position control device 15 will be described with reference to FIG. 8. The sheet position control device 15 is a microcomputer that includes a CPU, a ROM, a RAM, and an input and output interface (all not shown). The sheet feed motor 50, the conveyor motor 65 and the sheet feed switch 63 are electrically connected with the input and output interface. Therefore, the sheet feed motor 50 and the conveyor motor 65 are controlled by the sheet position control device 15.

Figure 11:
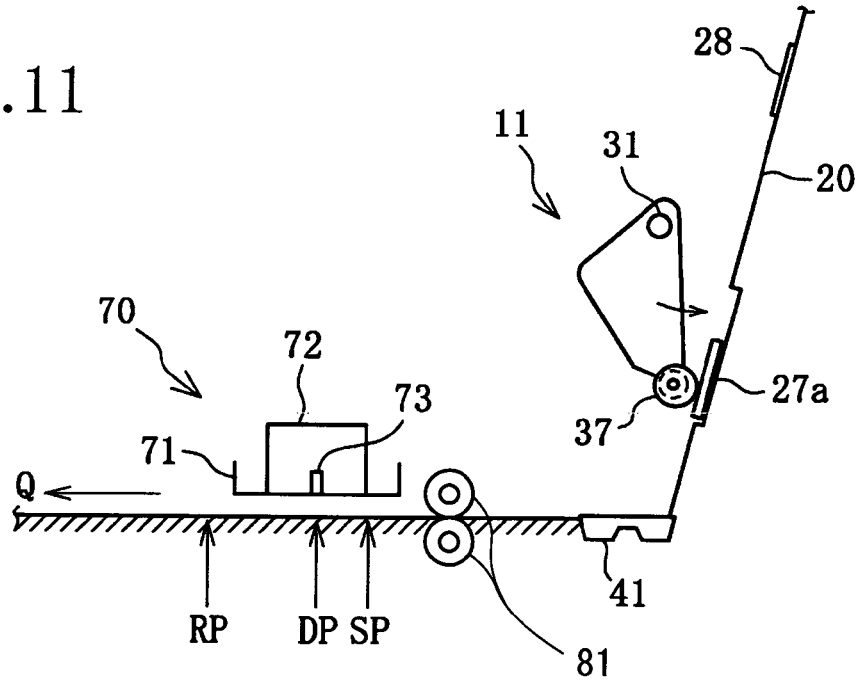
FIG. 11 is a schematic side view of the sheet-supply device and a printing unit.

A printing unit 70 will be described with reference to FIG. 11. The printing unit 70 is disposed downstream of the sheet-supply device 2 in the sheet feed direction Q. The printing unit 70 includes a carriage 71, a print head 72 mounted on the carriage 71, and a media sensor 73 (corresponding to a detecting unit) provided on the side of the print head 72. Although not shown in the drawings, the print head 72 has a plurality of ink-jet nozzles aligned in the sheet feed direction Q in accordance with the colors. The media sensor 73 includes a photosensor having a light-emitting portion and a photoreceptor portion and can detect a leading edge and a width of a sheet P fed from the sheet-supply device 2 by determining the presence or absence of the sheet P.

A leading edge detecting point DP is provided at the position where the media sensor 73 is located. A print starting point SP is provided at a position corresponding to the upstream end of the print head 72 in the sheet feed direction Q. A reverse feeding point RP is provided at a predetermined position downstream of the print head 72 in the sheet feed direction Q. That is, when a sheet P is fed to the printing unit 70, the leading edge of the sheet P is detected at the leading edge detecting point DP by the media sensor 73. Then, the sheet P is further conveyed by a pair of conveyor rollers, i.e. resist rollers 81, in the normal direction (sheet feed direction Q) until the leading edge of the sheet P reaches the reverse feeding point RP. When the leading edge reaches the reverse feeding point RP, the sheet P is conveyed in a reverse direction R, which is a direction reverse to the sheet feed direction Q, until a predetermined print start point in a print area of the sheet P aligns with the print starting point SP.

Figure 19:
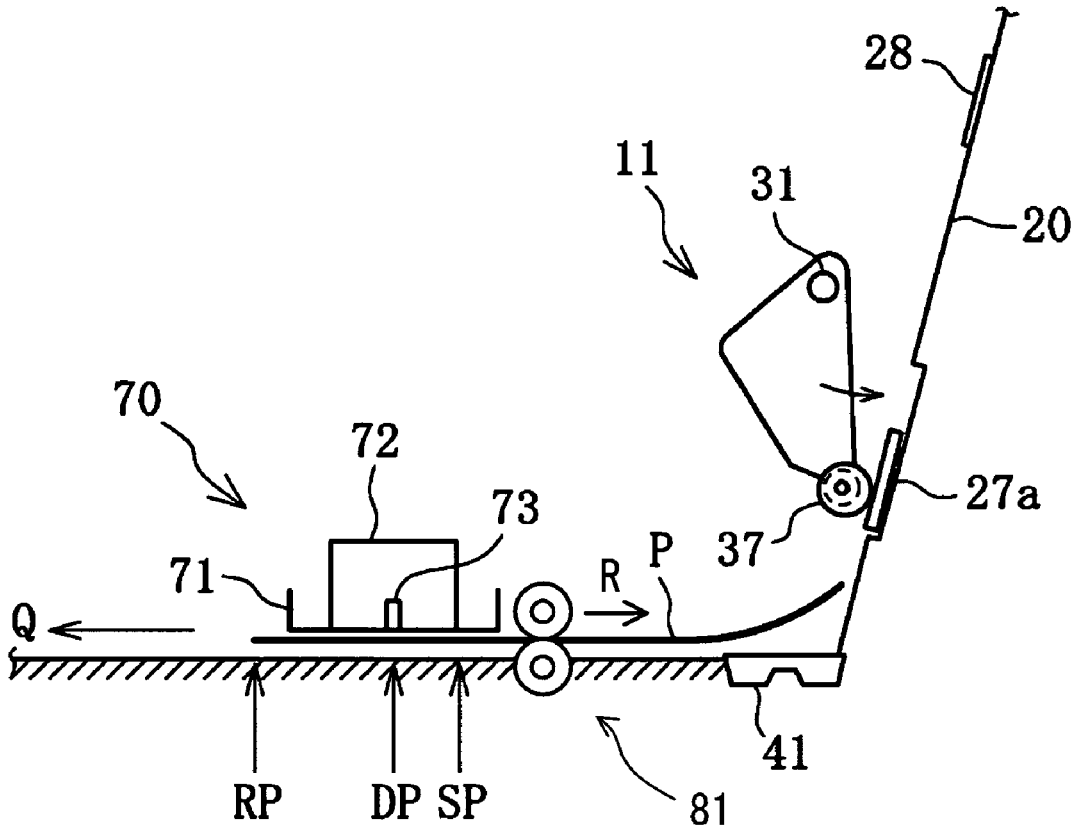
FIG. 19 is a schematic side view of the sheet-supply device and the printing unit when a small-sized sheet is being conveyed in a direction reverse to a sheet feed direction.

As the print start point of the sheet P aligns with the print starting point SP, a printing operation is performed by the print head 72 by normally conveying the sheet P in the sheet feed direction Q from the print starting point SP. However, in a case where a sheet P is short in length, such as a postcard, a trailing edge of the sheet P is released from the sheet-supply roller 37 when the leading edge of the sheet P reaches the reverse feeding point RP through the leading edge detecting point DP, as shown in FIG. 19.

Next, the operation of the sheet-supply device 2 will be described with reference to FIGS. 9 to 14. As shown in FIG. 9, a stack of sheets P are held by the hopper portion 10. In this state, the sheet-supply roller 37 presses a topmost sheet P toward the first friction member 27, that is, the inclined wall 20, at all times regardless of the amount of sheets loaded on the hopper portion 10. The gears 51 to 60 in the drive system and the sheet feed system are at a standstill in a rotation phase shown in FIG. 10. The stopper members 12 are located at the protruding position. In this state, until the sheet feed operation starts, a moving resistance is applied to the lower edges of the sheets P held in the hopper portion 10 by the saw-toothed regulating surfaces 12*a* of the stopper members 12 positioned at the protruding position. Accordingly, the sheets P are surely prevented from moving in the sheet feed direction Q.

Figure 12:
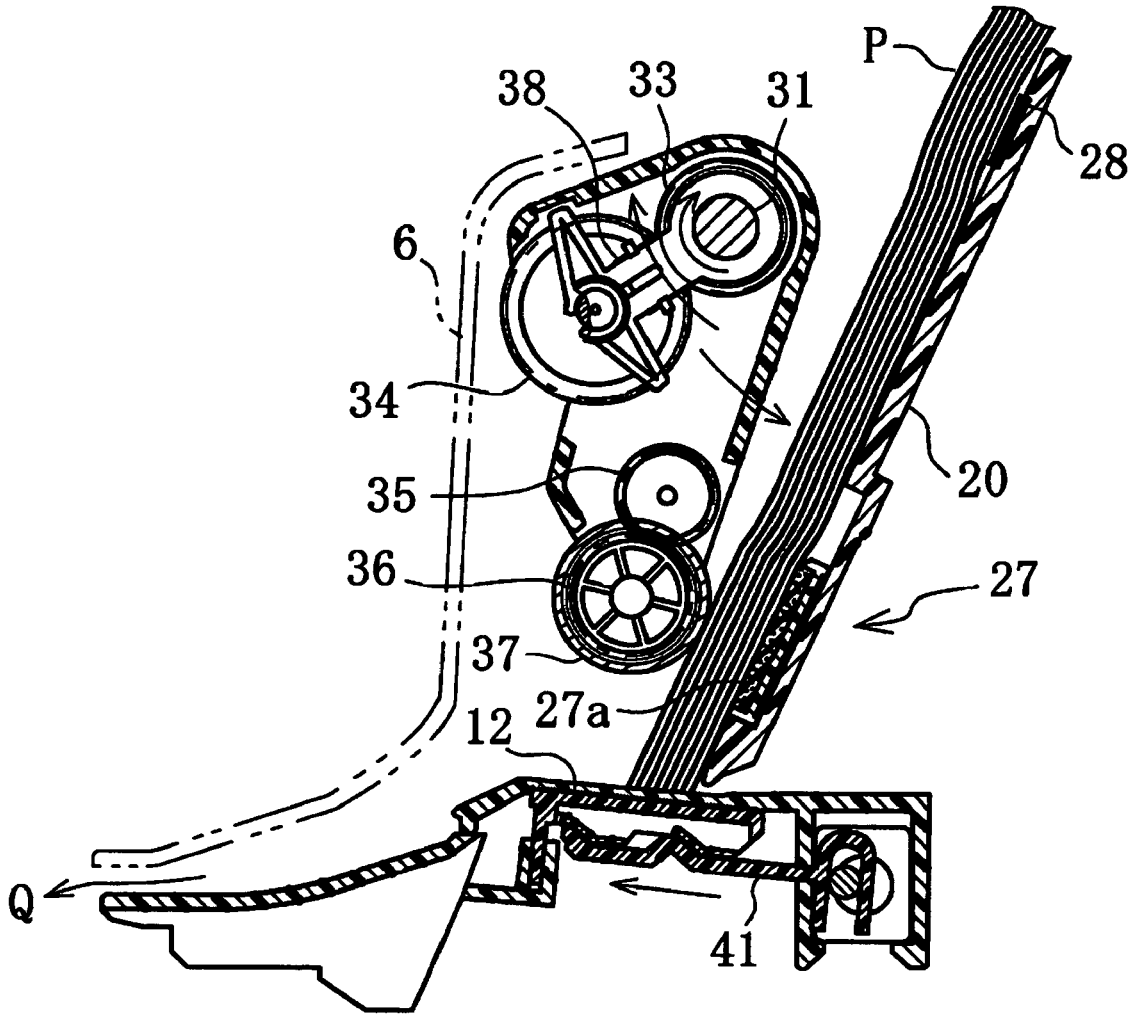
FIG. 12 is a sectional side view showing essential parts of the sheet feed mechanism, the position change mechanism, and the stopper members when the sheet feed operation starts.

Only when the stopper members 12 are positioned at the retracted position is a slide resistance applied to the lower edges of the middle areas of the sheets P by the separating pad 45. When the sheet feed operation starts, in a case where the sheet feed switch 63 is in the on state, that is, the stopper members 12 are located at the protruding position, first, the sheet position control device 15 rotates the sheet feed motor 50 in the reverse direction, as shown in FIG. 10, in order to rotate the up-and-down moving shaft 42 in the clockwise direction. By doing so, the stopper members 12 descend to the retracted position (FIG. 12).

Figure 13:
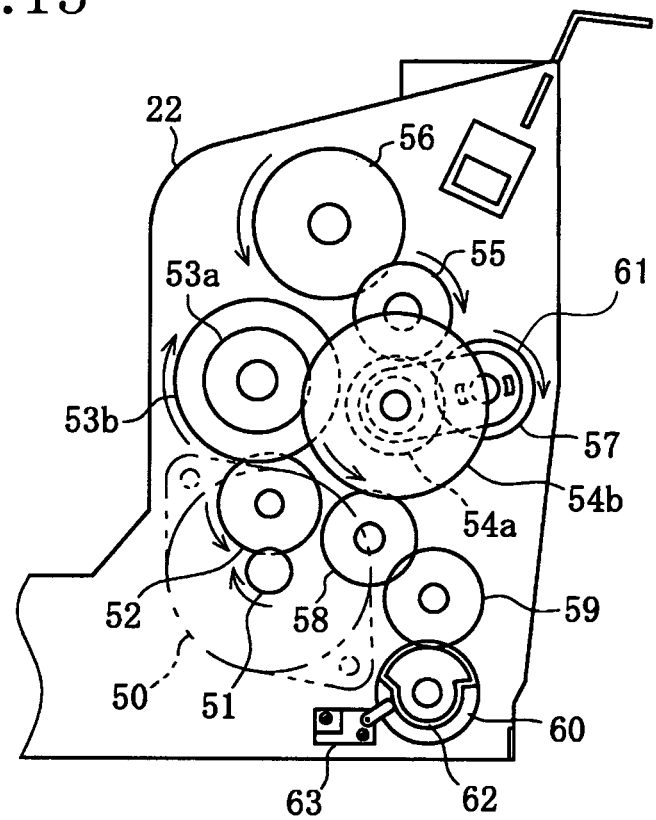
FIG. 13 is a diagram showing an operation of the sheet feed operation mechanism when the sheet feed operation starts.

Then, as the sheet feed switch 63 outputs an off signal, the sheet feed motor 50 stops driving. In this state, the sheet feed motor 50 rotates in the normal direction as shown in FIG. 13, so that the sheet feed shaft 31 rotates in the counterclockwise direction. Thus, the planet gear 34 engages the following gear 35, thereby rotating the sheet-supply roller 37 to feed the topmost sheet P. Because both the stopper members 12 are positioned at the retracted position during the sheet feed operation, the topmost sheet P can be smoothly fed by the sheet-supply roller 37. During the sheet feed operation, the rest of the sheets P are surely prevented from being fed in the sheet feed direction Q by the slide resistance applied by the separating pad 45 although the stopper members 12 are positioned at the retracted position.

Figure 15:
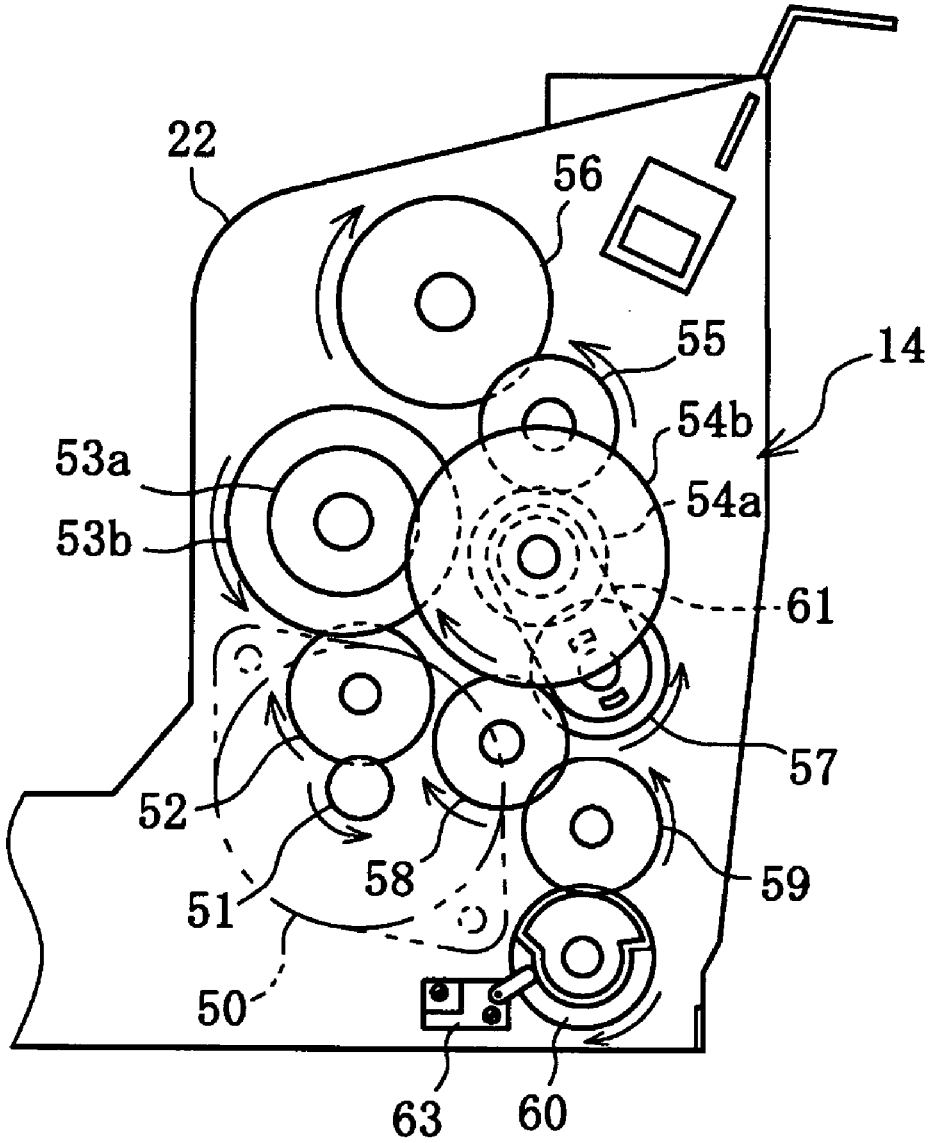
FIG. 15 is a diagram showing an operation of the sheet feed operation mechanism when the stopper members are ascended.

As the leading edge of the fed sheet P reaches the resist rollers 81, provided in the ink-jet printing device 4, and a deviation of the sheet P is corrected, the sheet feed motor 50 stops rotating in the normal direction, thereby temporarily stopping the sheet feed operation. After that, the sheet P is conveyed to the ink-jet printing device 4 by the resist rollers 81. After the sheet feed motor 50 is stopped rotating and the sheet feed operation is completed, as shown in FIG. 15, the sheet feed motor 50 is rotated in the reverse direction until the sheet feed switch 63 outputs an on signal, that is, the stopper members 12 reach the protruding position.

Figure 16:
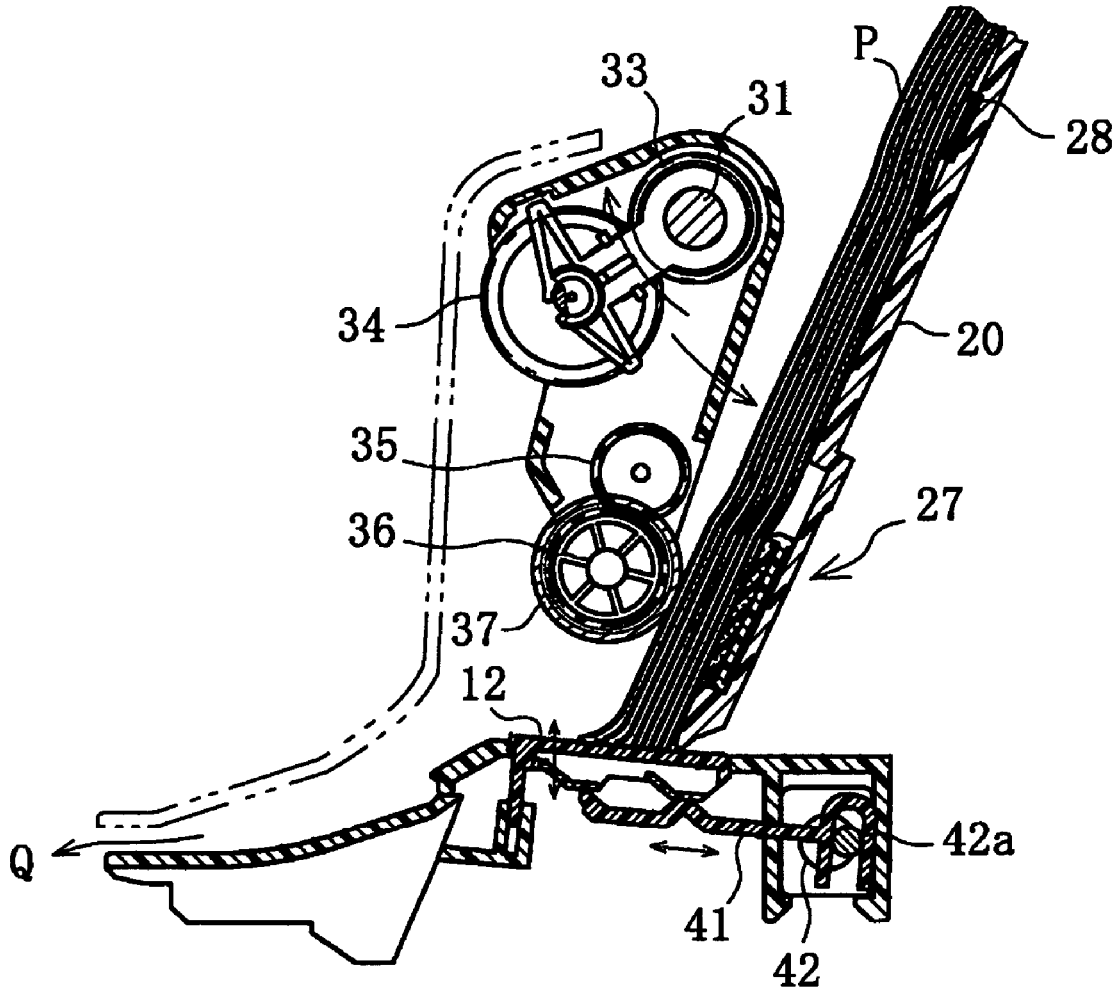
FIG. 16 is a sectional side view showing essential parts of the sheet feed mechanism, the position change mechanism, and the stopper members when the stopper members are moved up and down several times.

By locating the stopper members 12 at the protruding position, the rest of the sheets P are regulated by the regulating surfaces 12*a* of the stopper members 12 and thus the sheets P are prevented from moving (shifting) in the sheet feed direction Q. However, as shown in FIG. 16, there may be a case where a sheet P to be fed next and the rest of the sheets P are displaced to some extent in the sheet feed direction Q from the predetermined sheet holding position. This situation is likely to cause the multi-feed problem at the next sheet feed operation. In order to prevent the multi-feed problem, the sheet position control device 15 rotates the sheet feed motor 50 in the reverse direction several times to move the stopper members 12 up and down several times in accordance with the movement in the front and rear directions of the up-and-down moving members 41 several times. With this operation, the lower edges of the sheets P alternatively contact the separating pad 45 and the stopper members 12.

Figure 17:
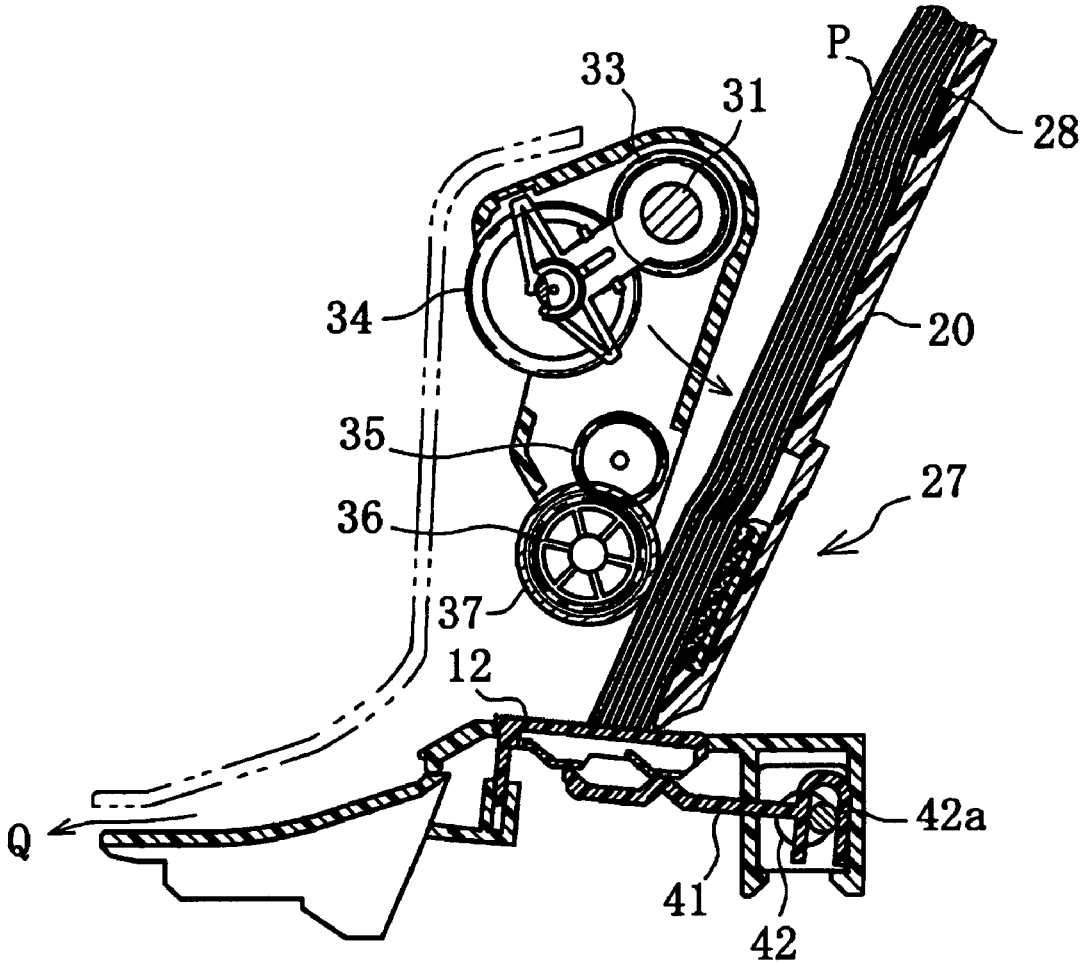
FIG. 17 is a sectional side view showing essential parts of the sheet feed mechanism, the position change mechanism, and the stopper members in a condition where sheets are positioned at a predetermined sheet holding position.
Figure 18:
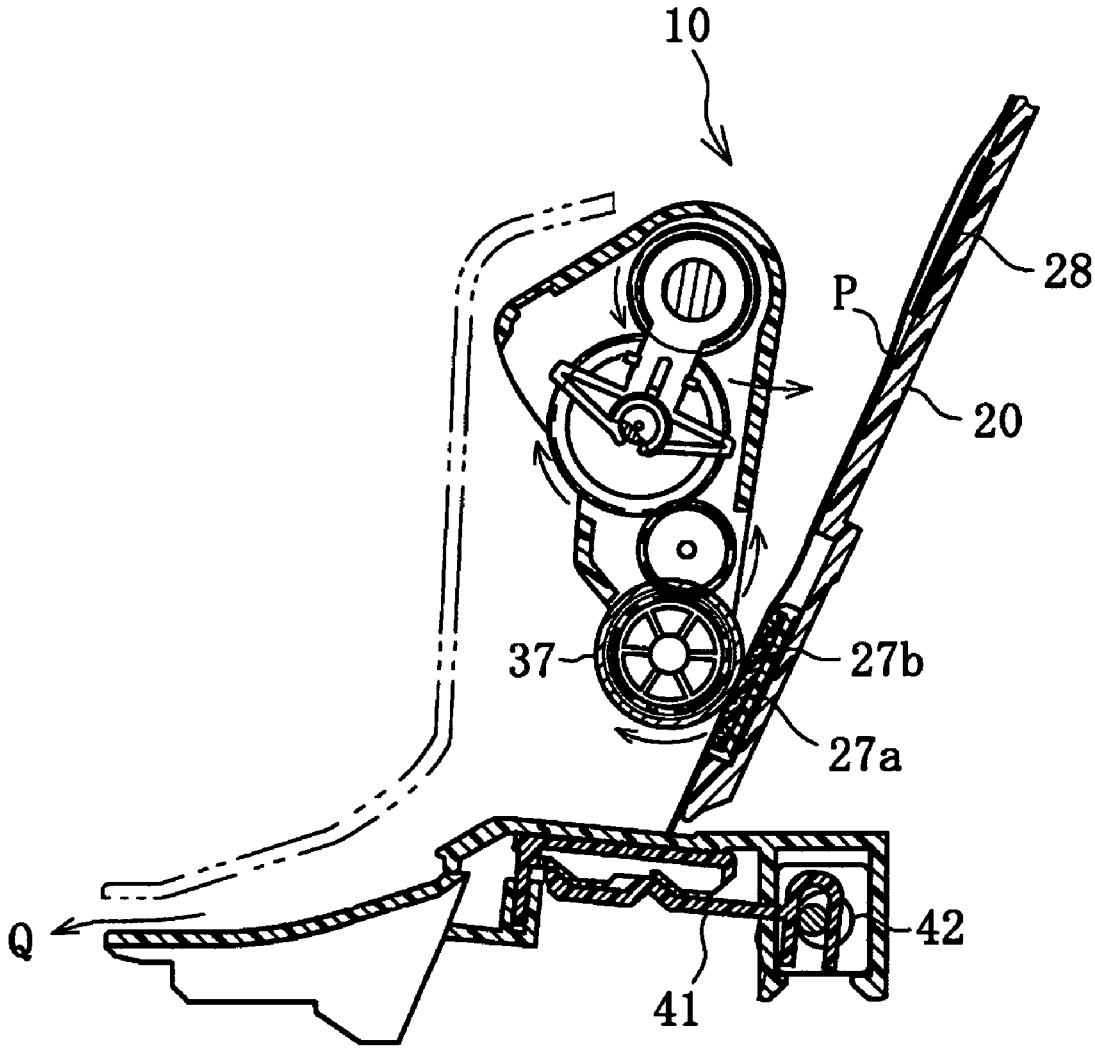
FIG. 18 is a sectional side view showing essential parts of the sheet feed mechanism, the position change mechanism, and the stopper members in process of the sheet feed operation when the amount of remaining sheets is low.

Because the sheet-supply roller 37 is resiliently urged toward the sheets P, as shown in FIG. 17, the sheets P displaced in the sheet feed direction Q are surely positioned at the predetermined sheet holding position every time the stopper members 12 are moved up and down between the protruding position and the retracted position. Therefore, the multi-feed problem can be prevented from occurring at the next sheet feed operation. When the amount of remaining sheets P held by the hopper portion 10 is low (for example, two or three sheets are left), the multi-feed problem often occurs at the time of feeding a topmost sheet P by the sheet-supply roller 37.

Because the first friction member 27 is provided at a position near the lower end of the inclined wall 20 and corresponding to the sheet-supply roller 37, a high frictional resistance is applied to a lowermost sheet P of the stack of sheets P loaded on the hopper portion 10. In addition, a frictional resistance occurs between adjacent sheets P of the rest of the sheets P, whereby the multi-feed problem is surely prevented and thus only a topmost sheet P contacting the sheet-supply roller 37 is fed in this case as well.

In a case where a small-sized sheet P, which is short in length, such as a postcard, is loaded on the hopper portion 10 and a borderless printing is performed on the small sheet P, a leading edge of the small sheet P is released from the sheet-supply roller 37 when the leading edge of the small sheet P reaches the reverse feeding point RP through the leading edge detecting point DP by conveying the sheet P in the sheet feed direction Q. This situation occurs because an upper margin of the small sheet P is substantially zero. After the leading edge of the sheet P reaches the reverse feeding point RP, the sheet P is fed back in the reverse direction R until its print start point aligns with the print starting point SP. The frictional resistance between the trailing edge portion of the sheet P and a sheet P to be fed next is small, so that the sheet P can be easily fed back over and along the next sheet P.

When the sheet P fed from the sheet-supply device 2 is the last one, that is, when no more sheets are left on the hopper portion, there is a possibility that the fed sheet P is caught between the sheet-supply roller 37 and the first friction member 27 and being bent into a V-shape. However, in this embodiment, the first friction member 27 can slide upward from the normal position where the first friction member 27 locates during the sheet feed operation, in accordance with the reverse feed operation, as shown in FIG. 20. As a result, a friction force against the small sheet P, caused by the sheet-supply roller 37 and the first friction member 27, becomes extremely small, so that the trailing edge of the sheet P can easily enter between the sheet-supply roller 37 and the first friction member 27.

As described above, in accordance with the reverse feed direction, the first friction member 27 can slide upstream in the sheet feed direction Q, from the normal position, along the inclined wall 20. With this structure, the multi-feed problem is surely prevented when the amount of remaining sheets is low. Further, when the borderless printing is performed on a small sheet P, the first friction member 27 slides upward in accordance with the reverse feed operation, so that the friction force against the small sheet P by the sheet-supply roller 37 and the pad portion 27*a* becomes extremely small. Accordingly, the trailing edge of the sheet can easily enter between the sheet-supply roller 37 and the pad portion 27*a* and the reverse feed operation can be stably and precisely performed.

Variations of the embodiment of the invention will be described below. The same parts are designated by similar reference numerals.

The first and second friction members 27, 28 can be made of a material, other than corkrubber, having a high coefficient of friction between the friction members 27, 28 and sheets P.

The first and second friction members 27, 28 may be provided at several positions on the inclined wall 20 with being symmetrical to each other.

The first and second friction members 27, 28 may be replacable with others having suitable dimensions (height and width) in accordance with a size and type of sheets to be loaded on the hopper portion 10.

As shown in FIGS. 21 to 24, a hopper portion 10A may comprise a hopper body 10X and a unitary inclined wall 20A. The hopper body 10X includes a bottom plate 21A, a lower end 20U of an inclined wall and side walls 22A, 23A. The unitary inclined wall 20A has a pair of guide members 25A, 26A. A plurality of engaged portions 10*a* to 10*c* may be provided at a rear end of the hopper portion 10X, and a plurality of engaging portions 20*a* to 20*c*, which can connect the engaged portions 10*a* to 10*c*, respectively, may be provided at corresponding positions of the unitary inclined wall 20A.

Figure 24:
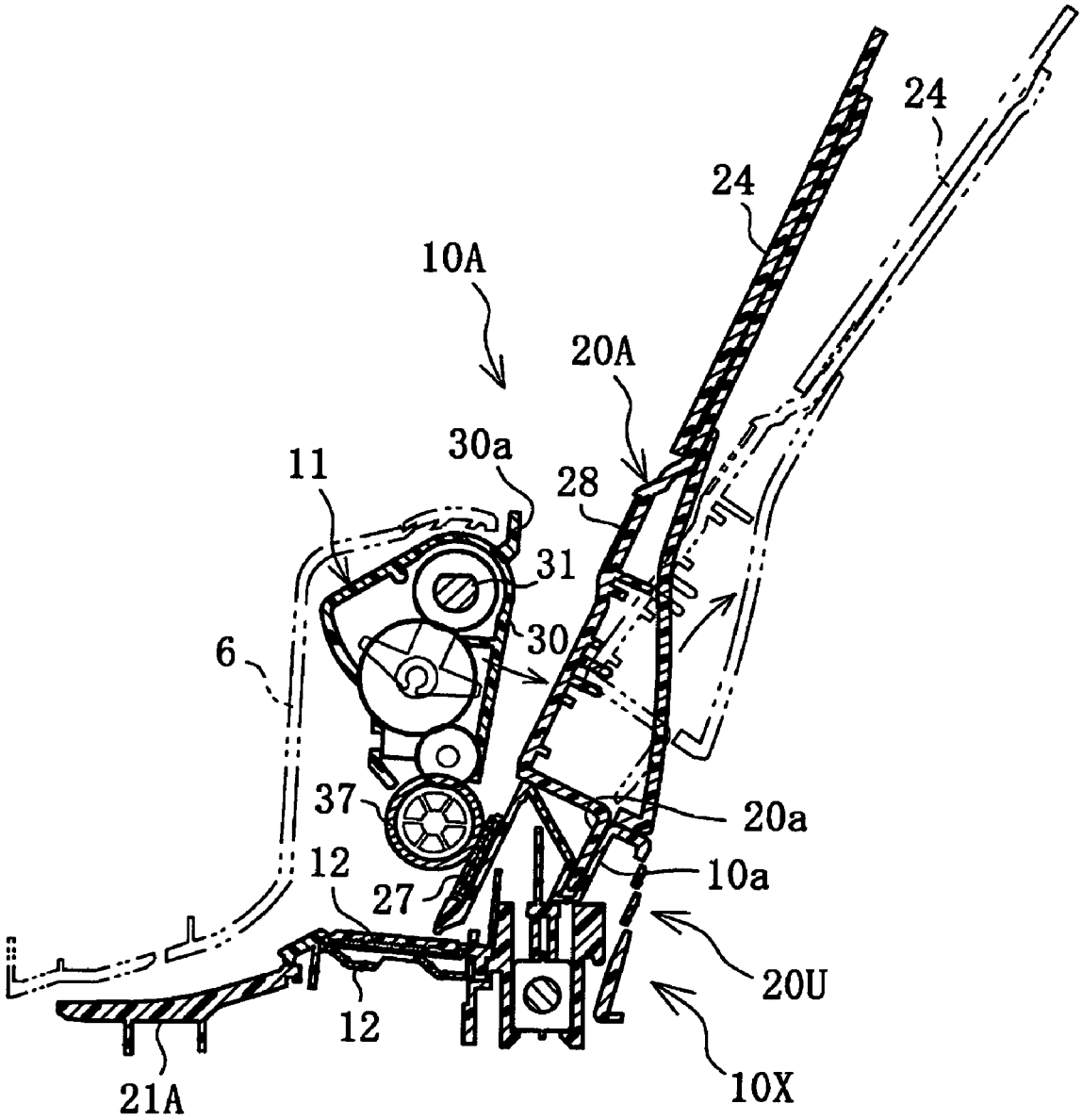
FIG. 24 is a sectional side view showing essential parts of the sheet feed mechanism, the position change mechanism, and the stopper members, including the hopper portion of the variation of the embodiment.

For the normal sheet feed operation, as shown in FIG. 24, the hopper body 10X and the unitary inclined wall 20A are integrally connected with each other by engaging the engaging portions 20*a* to 20*c* of the inclined wall 20A with the engaged portions 10*a* to 10*c* of the hopper body 10X, respectively. Then, a plurality of sheets P are loaded in the hopper body 10X and can be fed one by one. For example, when a paper jam occurs by which a fed sheet P is caught in a sheet feedpath and, thus, the sheet feed operation is stopped, the sheet P can be easily removed from the hopper body 10X, because the unitary inclined wall 20A can be removed from the hopper body 10X (see FIG. 24). Accordingly, troubleshooting for the paper jam is simplified.

In FIG. 24, when a paper jam occurs in the sheet-supply device 2 before a sheet P reaches the resist rollers 81, the user pinches and rotates a projection 30*a*, extending upward at the upper end of the case 30, using his/her fingers, in the clockwise direction against the force from the coil spring 32 to move the sheet-supply roller 37 away from the sheet P. By doing so, the jammed sheet P can be easily removed from the sheet-supply device 2 from the rear.

Although the invention has been described in detail with reference to a specific embodiment thereof, it would be apparent to those skilled in the art that various changes, arrangements and modifications may be applied therein without departing from the spirit and scope of the invention. For example, the invention can be applied to various sheet-supply devices provided in, for example, recording apparatuses and copying apparatuses.

What is claimed is:

1. A sheet-supply device for supplying sheets from a stack of sheets one at a time in a sheet feed direction, the sheet-supply device comprising:

a hopper portion that has an inclined wall for holding a stack of sheets in an inclined position and a lower edge receiving portion for receiving lower edges of the sheets;

a sheet feed mechanism that includes a sheet-supply roller for supplying a topmost sheet from the stack of sheets loaded on the hopper portion; and a first friction member, that is provided at a position near a lower end of the inclined wall of the hopper portion and corresponding to a position where the sheet-supply roller is provided, slidably movable along the inclined wall between a normal position where the first friction member is located during a normal sheet feed operation, and a second position upstream of the normal position in the sheet feed direction, the first friction member moves toward the second position when a sheet is fed in a direction opposite to the sheet feed direction and the sheet contacts the first friction member.

2. The sheet-supply device according to claim 1, wherein the first friction member includes a pad portion having a high coefficient of friction and a base portion having a low coefficient of friction relative to one another, and wherein the base portion is disposed slidably along the inclined wall of the hopper portion.

3. The sheet-supply device according to claim 2, wherein a frictional coefficient $\mu$ of the pad portion meets criteria: frictional coefficient between adjacent sheets $\leqq\mu\leqq 1.0$.

4. The sheet-supply device according to claim 2, wherein a slidable distance of the first friction member is longer than or equal to a distance that the fed sheet is conveyed upstream in the sheet feed direction after a trailing edge of the sheet is released from the sheet-supply roller in a sheet feed operation.

5. The sheet-supply device according to claim 1, further comprising a second friction member that is provided to the inclined wall and at a position higher than the position where the first friction member is provided.

6. The sheet-supply device according to claim 4, further comprising a detecting unit that detects a leading edge or a width of the fed sheet, wherein the slidable distance of the first friction member is equal to a distance between a point where a print head starts printing and a point where the detecting unit detects the leading edge of the sheet.

7. A printing device having a sheet-supply device for supplying sheets from a stack of sheets one at a time in a sheet feed direction, the sheet-supply device comprising:

a hopper portion that has an inclined wall for holding a stack of sheets in an inclined position and a lower edge receiving portion for receiving lower edges of the sheets;

a sheet feed mechanism that includes a sheet-supply roller for supplying a topmost sheet from the stack of sheets loaded on the hopper portion; and a first friction member, that is provided at a position near a lower end of the inclined wall of the hopper portion and corresponding to a position where the sheet-supply roller is provided, slidably movable along the inclined wall between a normal position where the first friction member is located during a normal sheet feed operation, and a second position upstream of the normal position in the sheet feed direction, wherein the first friction member moves toward the second position when a sheet is fed in a direction opposite to the sheet feed direction and the sheet contacts the first friction member.

8. The printing device according to claim 7, wherein the first friction member includes a pad portion having a high coefficient of friction and a base portion having a low coefficient of friction relative to one another, and wherein the base portion is disposed slidably along the inclined wall of the hopper portion.

9. The printing device according to claim 8, wherein a frictional coefficient $\mu$ of the pad portion meets criteria: frictional coefficient between adjacent sheets $\leqq\mu\leqq 1.0$.

10. The printing device according to claim 8, wherein a slidable distance of the first friction member is longer than or equal to a distance that the fed sheet is conveyed upstream in the sheet feed direction after a trailing edge of the sheet is released from the sheet-supply roller in a sheet feed operation.

11. The printing device according to claim 7, wherein the sheet-supply device further comprises a second friction member that is provided to the inclined wall and at a position higher than the position where the first friction member is provided.

12. The printing device according to claim 10, further comprising a detecting unit that detects a leading edge or a width of the fed sheet, wherein the slidable distance of the first friction member is equal to a distance between a point where a print head starts printing and a point where the detecting unit detects the leading edge of the sheet.

13. A sheet supply device for a printing device, comprising:

a paper hopper having a bottom surface, an inclined sheet receiving surface, and a pair of adjustable sheet side edge guides;

a first friction member slidably received on the inclined sheet receiving surface, the first friction member slideable in up and down directions relative to the printing device; and a sheet feed mechanism including a sheet feed roller, wherein the first friction member is normally located at a first position opposing the sheet feed roller with the sheets therebetween and is capable of taking a second position upwardly of the first position when a paper sheet is fed in a direction opposite to a print feed direction and is in contact with the first friction member.

14. The sheet supply device according to claim 13, wherein the first friction member has a surface that engages a sheet having a coefficient of friction μ such that:

coefficient of friction between adjacent sheets $\leqq \mu \leqq 1.0$.

15. The sheet supply device according to claim 13, further comprising a second friction member mounted to the inclined sheet receiving surface above the first friction member.

16. The sheet supply device according to claim 13, wherein the bottom surface includes a third friction member extending in a feed direction and providing a frictional resistance to lead edges, in the feed direction, of the sheets received in the paper hopper.

17. The sheet supply device according to claim 16, further comprising at least one stopper member retractably mounted in an opening in the bottom surface and extending in the feed direction.

18. The sheet supply device according to claim 17, wherein the at least one stopper member comprises two stopper members symmetrically positioned on each side of the third friction member.

19. The sheet supply device according to claim 17, wherein the at least one stopper member is retracted below the bottom surface during sheet feed.

20. The sheet supply device according to claim 17, wherein the at least one stopper member has a sawtooth profile, an opening angle ∞ of each sawtooth between 45° and 90°.

* * * * *